US006017380A

United States Patent [19]

Kitamura et al.

[11] Patent Number: 6,017,380

[45] Date of Patent: Jan. 25, 2000

[54] TOP-BLOWN REFINING METHOD IN CONVERTER FEATURING EXCELLENT DECARBURIZATION AND TOP-BLOWN LANCE FOR CONVERTER

[75] Inventors: Shinya Kitamura; Kenichiro Naito, both of Futtsu; Kimitoshi Yonezawa; Shinji Sasakawa, both of Kitakyushu; Shin Kikuchi, Oita; Yuji Ogawa; Takeo Inomoto, both of Futtsu, all of Japan

[73] Assignee: Nippon Steel Corporation, Tokyo, Japan

[21] Appl. No.: 08/860,766

[22] PCT Filed: Jan. 5, 1996

[86] PCT No.: PCT/JP96/00008

§ 371 Date: Jul. 3, 1997

§ 102(e) Date: Jul. 3, 1997

[87] PCT Pub. No.: WO96/21047

PCT Pub. Date: Jul. 11, 1996

[30] Foreign Application Priority Data

| | | | |
|---|---|---|---|
| Jan. 6, 1995 | [JP] | Japan | 7-000794 |
| Mar. 3, 1995 | [JP] | Japan | 7-44602 |
| Mar. 27, 1995 | [JP] | Japan | 7-67346 |
| Mar. 27, 1995 | [JP] | Japan | 7-67348 |
| Apr. 12, 1995 | [JP] | Japan | 7-87279 |

[51] Int. Cl.[7] ..... C21C 5/32; C21C 5/46

[52] U.S. Cl. ..... 75/553; 266/225

[58] Field of Search ..... 266/225; 75/553

[56] References Cited

FOREIGN PATENT DOCUMENTS

| | | |
|---|---|---|
| 60-63307 | 4/1985 | Japan . |
| 60-131908 | 7/1985 | Japan . |
| 60-228424 | 10/1987 | Japan . |
| 1-123016 | 5/1989 | Japan . |
| 1-219116 | 9/1989 | Japan . |
| 2-156012 | 6/1990 | Japan . |
| 95/18346 | 7/1995 | WIPO . |

*Primary Examiner*—Melvyn Andrews

*Attorney, Agent, or Firm*—Kenyon & Kenyon

[57] ABSTRACT

A refining method for decarburization by blowing by using a top-blown lance having a gas-supplying pipe of at least one independent line, wherein the absolute secondary pressure $P_0$ of nozzle of the lance of at least one line is maintained to be not smaller than 0.7 times but not larger than 2.5 times of the properly expanding absolute secondary pressure $P_{0p}$ of nozzle of the lance, and the oxygen supplying rate is so changed that a maximum value of the absolute secondary pressure of the nozzle is not smaller than 1.1 times of a minimum value thereof. The top-blown lance used here has not less than 2 but not more than 10 shielding portions arranged in the openings at the end of the lance in a concentric polygonal shape or a concentric circular shape in cross section, has a ratio B/h of the length h (mm) of the short side to the length B (mm) of the long side of the openings separated by the shielding portions of from 10 to 225, has slit-like nozzles of which the ratio (B·h)/R is from 0.4 to 4 mm when the diameter of the lance is R (mm), and has 1 to 6 circular nozzles that are coupled to a gas-supplying pipe independent from said slit-like nozzles and are arranged on the inside of said concentric polygon or said concentric circle.

21 Claims, 11 Drawing Sheets

TOP-BLOWN REFINING METHOD IN CONVERTER FEATURING EXCELLENT DECARBURIZATION AND TOP-BLOWN LANCE FOR CONVERTER

TECHNICAL FIELD

The present invention relates to a refining method featuring excellent decarburization in a top- and bottom-blown converter and to a top-blown lance for the converter.

BACKGROUND ART

The refining reaction in a top-blown converter and in a top- and bottom-blown converter proceeds by supplying an oxygen gas from a top-blown lance to oxidize impurities such as carbon, silicon, phosphorus, etc. Furthermore, the top-blown lance usually employs a convergent-divergent nozzle having a single aperture or a plurality of apertures in order to efficiently convert the secondary pressure of the lance into kinetic energy of a jet of oxygen gas, and as a result, the stirring in a steel bath is promoted by the jet. ("Handbook of Steels", 3rd edition, separate volume II, the Japanese Association of Steels, 1982, p. 468).

In order to impart stirring force to a steel bath according to a conventional method, the top-blown lance as described above is used and the refining is carried out under a secondary pressure within a proper range of expansion of the convergent-divergent nozzle from the first period of refining up to the last period of refining, however, an optimum flow rate or a velocity of jet of oxygen gas depending upon the refining steps cannot be selected freely. At the rate determining step of supplying oxygen in the initial period of refining, therefore, when the flow rate of oxygen gas is increased to increase the rate of decarburization, the velocity of jet of oxygen gas is increased, as a result, the amount of dust and spitting increases. At the rate determining step of supplying carbon in the last period of refining, furthermore, when the flow rate of oxygen gas is decreased to prevent super oxidizing of the steel bath and increasing the iron oxide in the slag, the velocity of jet becomes so small that the temperature at a hot spot where jet impinges on the steel bath drops or the stirring force becomes insufficient, resulting in a decrease in the rate of decarburization.

In general, the following three requirements are necessary for the decarburization in the converter, i.e., ① in a high carbon range, dust is generated less and the slag is formed quickly, ② in an intermediate carbon range, the decarburization oxygen efficiency is high, and ③ the decarburization proceeds up to a low carbon range while suppressing the formation of iron oxide.

Among them, it has been considered that the converter dust of ① is generated from two sources, i.e., the dust is generated from a surface (hot spot) where the top-blown oxygen impinges the steel bath, namely, is generated by vaporization of iron from the high-temperature hot spot or is generated by volumetric expansion of a molten steel which occurs when the CO gas is formed by the decarburization reaction at the hot spot.

A variety of methods have heretofore been proposed to increase the iron yield by decreasing the amount of dust generated during the blowing in the converter.

Japanese Unexamined Patent Publication (Kokai) No. 2-156012 discloses a method by which the height of the lance is increased and an inert gas is mixed into the top-blown gas in order to decrease the amount of dust formation. According to this method, the post combustion rate increases accompanying an increase in the height of the lance, and the heat transfer efficiency decreases. Therefore, melt loss increases considerably in the converter refractories. Besides, inert gas is used in large amounts, which is disadvantageous.

According to "Materials and Processes", Vol. 7, 1994, p. 229, the generating rate of dust is dependent upon a value that is obtained by dividing the oxygen supplying rate by the area of hot spot. When the supplying rate of oxygen is lowered to lower the oxygen supplying rate per a unit area of a hot spot, the productivity decreases. When a nozzle having many apertures is used to increase the area of hot spot, on the other hand, the hot spots are overlapped one upon the other causing the splash to increase. When the height of the lance is increased, furthermore, the post combustion rate increases causing the heat transfer efficiency to decrease. Therefore, melt loss occurs conspicuously in the converter refractories.

Japanese Unexamined Patent Publication (Kokai) No. 62-223424 discloses technology for increasing the post combustion rate by using a top-blown lance nozzle that is greatly deformed like that of a star type. Though there has been described no effect of this technology for decreasing dust or splash, simple use of this lance does not help decrease the dust.

When these technologies for lowering dust are summarized, the velocity of jet of the oxygen gas arriving at the bath surface can be decreased, i.e., the jet velocity (u) can be lowered or, in other words, a soft blow is accomplished. In a state of soft blow, however, only a small stirring force is produced by the top-blown gas, and the temperature drops in the region (hot spot) where the jet of oxygen gas impinges the bath surface. Therefore, the decarburization oxygen efficiency starts decreasing from a range of a high carbon concentration, and the above-mentioned object ② is not fulfilled.

There has further been proposed technology for maintaining a high decarburization efficiency even in the low carbon concentration range ③ mentioned above. For example, Japanese Unexamined Patent Publications (Kokai) Nos. 60-131908 and 60-63307 disclose technology for mixing a top-blown oxygen gas and an inert gas as represented by argon together in the ultra-low carbon range. These methods, however, require argon gas in large amounts, resulting in a great increase in the cost of gas.

In order to fulfill the above-mentioned objects ① to ③, therefore, it is the best method to supply large amounts of oxygen in a soft blowing manner in the high carbon range, to supply large amounts of oxygen in a hard blowing manner in the intermediate carbon range, and to supply small amounts of oxygen in a hardly blowing manner in the low carbon range.

Japanese Examined Patent Publication (Kokoku) No. 47-4770, on the other hand, discloses a lance provided with c spindle having an operation mechanism that moves up and down in a tubular passage between the opening at an end of a circular oxygen nozzle of the top-blown lance and a throat portion (narrowest portion of the lance nozzle). In this case, oxygen flows through slit portions formed in gaps between the circular nozzle and the spindle, but the jets passing through the gaps meet together immediately after the opening to establish a hard blow. Even when the gaps are broadened, therefore, a soft blow is not realized.

Furthermore, Japanese Unexamined Patent Publication (Kokai) No. 1-123016 discloses a lance having a nozzle for inert gas such as Ar or $CO_2$ in addition to a nozzle for supplying oxygen. In this case, even when the flow rate of the oxygen gas is lowered, the velocity of the jet doss not decrease due to the inert gas. However, since the oxygen gas is supplied from only one kind of nozzle, the skull is formed on the nozzle to clog it when the flow rate of the oxygen gas is greatly lowered. It is not, therefore, possible to greatly change the flow rate of the oxygen gas or the velocity of jet.

Japanese Unexamined Patent Publication (Kokai) No. 1-219116 discloses a lance having a main hole and a sub-hole which is coupled to an oxygen-supplying pipe which is independent from the main hole. Due to the problem of clogging of the nozzle caused by forming the skull, however, it is not allowed to greatly decrease the flow rate of the oxygen gas. Besides, since the oxygen gas is supplied through both the main hole and the sub-hole, it is not possible to greatly change the flow rate or the velocity of the jet of oxygen gas.

DISCLOSURE OF THE INVENTION

The object of the present invention is to solve the above mentioned defects and to provide a method which maintains the velocity of a jet within a nearly predetermined range without affected the flow rate of the oxygen gas by solving the above-mentioned defects, in order to realize the high-speed blowing, to lower dust and spitting, to prevent super oxidizing of the steel bath and to lower the amount of iron oxide in the slag, without employing a complex mechanism.

Another object of the present invention is to provide a novel nozzle for a top-blown converter which is based on the two new discoveries, i.e., the velocity of flow of a gas blown through a so-called long and narrow shaped jet hole having a large ratio of the short side to the long side and a suitable shape of jet hole, greatly attenuates immediately after it is blown compared with that of the gas blown through a circular hole, as a result, it is possible to realize a soft blow, and by a gas blown through an elongated jet hole and a gas blown through a separate circular nozzle are combined together under suitable conditions, it is possible to realize a hard blow.

In order to accomplish the above-mentioned objects, the present invention provides a method of blowing for decarburization as well as a nozzle for blowing as described below.

That is, the gist of the present invention resides in a refining method in a converter by utilizing an improperly expanding jet wherein, in effecting the blowing for decarburization by using a top-blown lance, the absolute secondary pressure $P_0$ of a nozzle is maintained within a range of from 0.7 to 2.5 times as great as the properly expanding absolute secondary pressure $P_{0p}$ of the nozzle of the lance, and the flow rate of the oxygen gas is changed by at least one time changing the absolute secondary pressure during the blowing.

In the above-mentioned method of the present invention, furthermore, accompanying a change in the absolute secondary pressure $P_0$ of nozzle, a distance LG between an end of the lance and a static bath surface of the molten steel as calculated according to the following formula (1) is so adjusted that a cavity depth L in the molten steel is maintained within a range of ±20% of a predetermined value, $$LG = H_c/(0.016\cdot L^{0.5}) - L \tag{1}$$

$$H_c = f(P_0/P_{0p})\cdot M_{0p}\cdot(4.2+1.1M_{0p}^2)\cdot d$$

-continued $$f(x) = \begin{cases} -2.709X^4 + 17.71X^3 - 40.99X^2 + 40.29X - 12.90 & (\text{when } 0.7 < X \leqq 2.1) \\ 0.109X^3 - 1.432X^2 + 6.632X - 6.35 & (\text{when } 2.1 < X < 2.5) \end{cases}$$

LG: distance (mm) between the end of the lance and the static bath surface of the molten steel, L: predetermined cavity depth (mm) in the molten steel, $P_0$: absolute secondary pressure (kgf/cm$^2$) of nozzle, $P_{0p}$: properly expanding absolute secondary pressure (kgf/cm$^2$) of nozzle, $M_{0p}$: discharge Mach number (–) during the proper expansion, d: diameter (mm) of a throat portion of the nozzle.

The absolute secondary pressure $P_0$ of nozzle is an absolute pressure of a stagnating portion over the throat portion of the nozzle. The properly expanding absolute secondary pressure of nozzle $P_{0p}$ is calculated in accordance with the following formula (2), $$S_e/S_1 = 0.259(P_e/P_{0p})^{-3/7}\,[1-(P_e/P_{0p})^{2/7}]^{-1/2} \tag{2}$$

$S_e$: area (mm$^2$) of nozzle opening, $S_t$: area (mm$^2$) of throat portion of nozzle, $P_e$: absolute pressure (kgf/cm$^2$) of atmosphere in the nozzle opening, $P_{0p}$: properly expanding absolute secondary pressure (kgf/cm$^2$) of nozzle.

The discharge Mach number $M_{0p}$ during the proper expansion of the formula (1) is calculated in accordance with the following formula (3), $$M_{0p} = [5\cdot\{(P_{0p}/P_e)^{2/7}-1\}]^{1/2} \tag{3}$$

$M_{0p}$: discharge Mach number (–) during the proper expansion, $P_e$: absolute pressure (kgf/cm$^2$) of atmosphere in the nozzle opening, $P_{0p}$: properly expanding absolute secondary pressure (kgf/cm$^2$) of nozzle.

According to the present invention as described above, the absolute secondary pressure $P_0$ of the nozzle is changed at least one time while maintaining a nearly constant distance LG between the end of the nozzle and the static bath surface of the molten steel found according to the above-mentioned formula (1) in an improperly expanding range where an absolute secondary pressure ratio $P_0/P_{Op}$ of nozzle is from 0.85 to 1.75, and the oxygen supplying rate is decreased depending upon the amount of the solid-dissolved carbon remaining in the molten steel without changing the velocity of the jet of the oxygen gas and maintaining a predetermined depth of the cavity in the molten steel. According to the method of the present invention, therefore, the molten steel is stirred to a sufficient degree in the last period of decarburization and the formation of iron oxide is suppressed.

In a range where an absolute secondary pressure ratio $P_0/P_{0p}$ of nozzle is from 0.7 to 2.5 but outside a range where an absolute secondary pressure ratio $P_0/P_{0p}$ of nozzle is from 0.85 to 1.75, furthermore, a distance LG between the end of lance and the static bath surface of the molten metal is found in accordance with the formula (1) accompanying a change in the absolute secondary pressure of nozzle $P_0$ so that a predetermined cavity depth L in the molten steel is maintained within a range of ±20% of a predetermined value, and the blowing is executed at the above-found height of the lance, i.e., the distance LG.

When the absolute secondary pressure of nozzle $P_0$ is large, i.e., when the oxygen supplying rate is large, therefore, a comparison of the distance LG for obtaining a predetermined cavity depth L in the molten steel by using a nozzle of which the pressure $P_0$ is the properly expanding absolute secondary pressure $P_{0p}$ with the distance LG for obtaining the same cavity depth L in the molten steel by using the nozzle of the present invention, indicates that the distance LG according to the present invention becomes much smaller than the distance LG when using the nozzle of which the absolute secondary pressure $P_0$ is $P_{0p}$. That is, in the initial period of blowing, it is possible to execute the blowing to a sufficient degree without the need of increasing the height of the lance to such a degree that the converter refractories are damaged.

Moreover, in the case where the absolute secondary pressure $P_0$ of the nozzle is small, i.e., in the case where the oxygen supplying rate is small, when cavity depth L is obtained by using the nozzle of the present invention to the same degree as the cavity depth L in the molten steel which is obtained by using the nozzle of which $P_0$ is $P_{0p}$, the distance LG in the case of the present invention becomes much larger than the distance LG of when the nozzle of which the pressure $P_0$ is the properly expanding absolute secondary pressure $P_{0p}$ is used. That is, in the last period of blowing, the blowing can be executed to a sufficient degree without the need of lowering the lance to a low position at which the end of the lance is thermally deformed and is damaged.

In the blowing method of the present invention, the oxygen supplying rate per a unit weight of the molten steel is set to be from 150 to 300 $Nm^3/h/ton$ when the carbon concentration is not smaller than 0.5% and is set to be from 20 to 100 $Nm^3/h/ton$ when the carbon concentration is up to 0.2%.

Here, the oxygen supplying rate is calculated in accordance with the following formula (4), $$F_{02}=0.581\cdot S_1\cdot\epsilon\cdot P_0/\text{weight of processed molten steel (tons)} \quad (4)$$

$F_{02}$: oxygen supplying rate ($Nm^3/h/ton$), $S_1$: area ($mm^2$) of throat portion of nozzle, $P_0$: absolute secondary pressure of nozzle ($kgf/cm^2$), $\epsilon$: coefficient (–) of flow rate (usually within a range of 0.9 to 1.0).

The present invention is further characterized by the use of a top-blown lance having gas pipes of two to four independent lines and having a ratio of a minimum line to a maximum line in the total area of the nozzle throat portions of from 2 to 10.

The present invention provides a lance having gas pipes of two independent lines, i.e., a top-blown lance for a converter having an oxygen-supplying pipe with 2 to 10 shielding portions in the long and narrow shaped nozzle openings of a concentric polygonal shape having 3 to 16 corners or of a concentric circular shape in cross section, and having 1 to 6 circular nozzles formed on the inside of the concentric polygonal or circular long and narrow shaped nozzles independent of the above-mentioned oxygen-supplying pipe.

In order to realize a soft blow by attenuating the velocity of jet of the oxygen gas blown from the nozzles, it is important to employ nozzles of a suitably long and narrow shape instead of employing nozzles of a circular shape. Even if the gas is blown from long and narrow shaped nozzles, the gas decays little when it is merged with a gas blown from other nozzles, and creates a hard blow. The above-mentioned lance was invented by utilizing these characteristics. The lance of the present invention is constituted by two elements, i.e., forming suitably the long and narrow shaped nozzles that create a soft blow, and a relationship between the long and narrow shaped nozzles and circular nozzles of the inner side for properly accomplishing the merging.

In the present invention, by using of the above-mentioned lance, the distance LG, i.e., the height of the end of the lance, can be maintained at a still lower position in the initial period and in the intermediate period of blowing.

BEST MODE FOR CARRYING OUT THE INVENTION

First, a top-blown lance used in the present invention will be described with reference to FIG. 2.

Figure 2A:
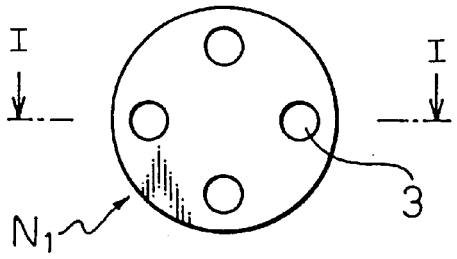
FIG. 2(A) is a plan view of a lance having one line.
Figure 2C:
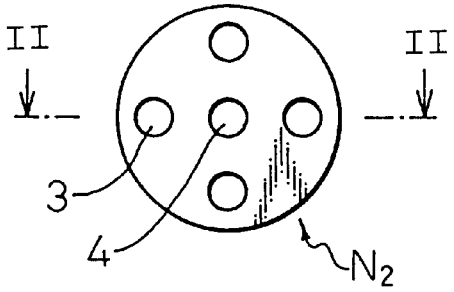
FIG. 2(C) is a plan view of a lance having two lines.
Figure 2B:
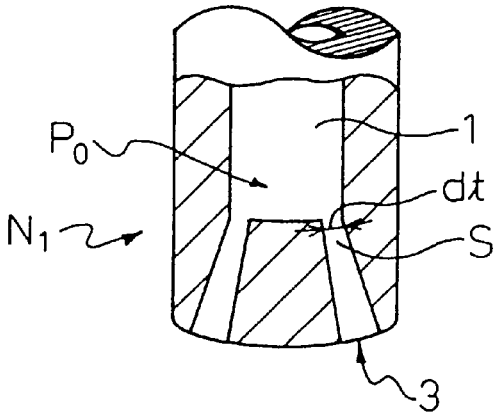
FIG. 2(B) is a sectional view along the line X—X of FIG. 2(A)
Figure 2D:
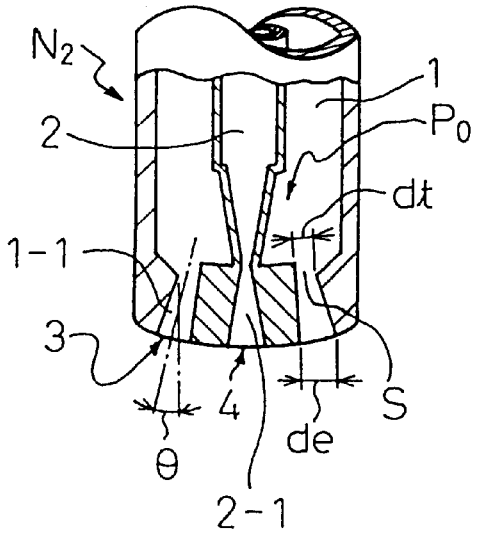
FIG. 2(D) is a sectional view along the line Y—Y of FIG. 2(C)

FIG. 2 illustrates an end portion of the lance, wherein FIG. 2(A) is a plan view of a lance having one line, FIG. 2(B) is a sectional view along the line X—X of FIG. 2(A), FIG. 2(C) is a plan view of a lance having two lines, and FIG. 2(D) is a sectional view along the line Y—Y of FIG. 2(C).

In FIG. 2, the lance $N_1$ of one line has circular nozzles 1—1 formed in the end of a circular gas-supplying pipe 1 so as to be opened as designated at 3 in the end surface of the lance. The lance $N_2$ of two lines has a central circular gas-supplying pipe 2 arranged at the center of the circumferential circular gas-supplying pipe 1, end has nozzles 1—1 and 2-1 that are opened as designated at 3 and 4 in the end surface of the lance. Symbol $d_t$ denotes a diameter of a nozzle throat portion S, and $d_e$ denotes a diameter of the opening 3 or 4. The absolute secondary pressure $P_0$ of the nozzle represents the absolute secondary pressure of a gas in the stagnating portion over the nozzle throat portion, and assumes a value obtained by adding 1.033 kgf/cm$^2$ (atmospheric pressure) to a value indicated on an ordinary pressure gauge. The properly expanding absolute secondary pressure $P_{0p}$ of nozzle is a value found in accordance with the above-mentioned formula (2) and is a constant value determined by the shape of the lance. Symbol $P_e$ is a pressure on the outside of the nozzle and is, usually, atmospheric pressure.

According to the present invention, the oxygen gas is supplied to the molten steel by using the above-mentioned nozzles. So far, however, it had been thought that a relationship between $P_0/P_{0p}$ and $U_{max}/U_{maxP}$ [$U_{max\ 1}$ is a maximum jet velocity on a plane perpendicular to the direction of the gas jet, $U_{maxP}$ is a maximum jet velocity of during the proper expansion (expansion which occurs when $P_0$ is the same as $P_{0p}$ determined by the shape of a nozzle from which the gas is released), and the jet velocity u is a measured value] was a positive-phase-sequence relationship.

So far, as described above, the blowing has been carried out under a secondary pressure within a range of proper expansion of the nozzle (e.g., $U_{max}/U_{maxP}$:1 when $P_0/P_{0p}$:1 in FIG. 1) from the initial period to the last period of refining, and it was not possible to freely select an optimum oxygen supplying rate ($F_{02}$) or the jet velocity (u) that suits the steps of refining.

Figure 1:
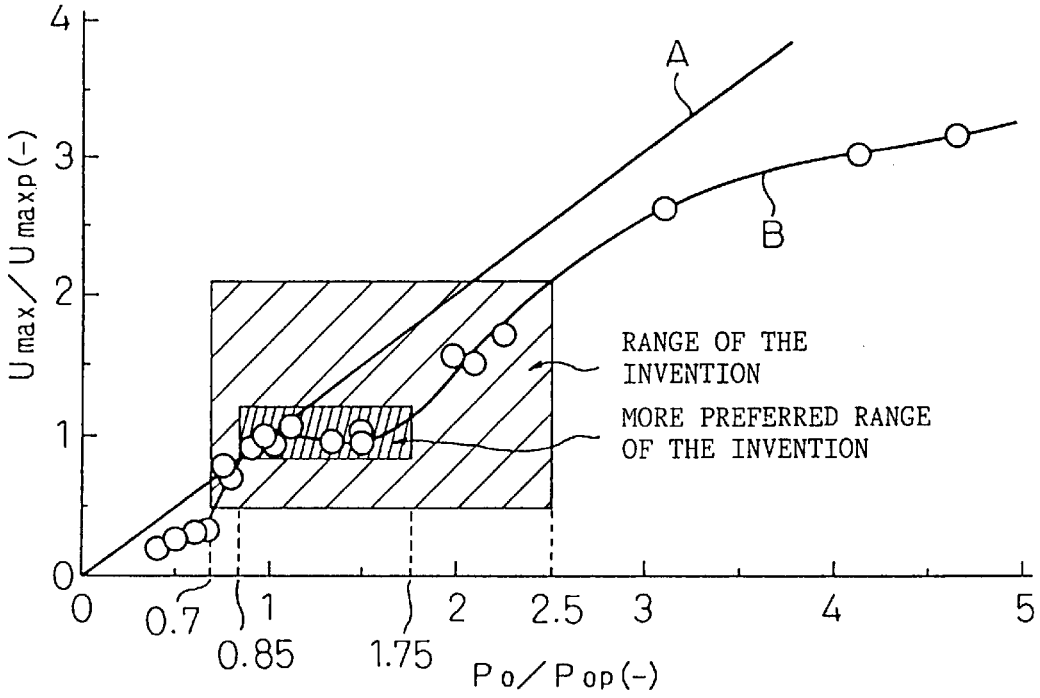
FIG. 1 is a diagram illustrating a relationship between a ratio $P_0/P_{0p}$ of a properly expanding absolute secondary pressure $P_{0p}$ of nozzle to an absolute secondary pressure $P_0$ of nozzle of a blowing lance and a ratio $U_{max}/U_{maxP}$ of a maximum jet velocity $U_{maxP}$ of during the proper expansion to a maximum jet velocity $U_{max}$ on a plane perpendicular to the direction of travel of the jet.

The present inventors have closely studied the above-mentioned relationship and have discovered the one as represented by a curve B in FIG. 1.

That is, the inventors have confirmed that $U_{max}$ sharply decreases from a ratio $P_0/P_{0p}$ of 2.5, becomes nearly constant in a region of from a ratio $P_0/P_{0p}$ of 1.75 to 0.85, and decreases again from this region to 0.7.

This means that a suitable oxygen supplying rate can be adjusted over a wide range, depending upon the steps of refining, while maintaining a maximum jet velocity without greatly changing the height LG of the lance compared to that of the traditional operation.

That is, if the absolute secondary pressure of a nozzle is changed, during the blowing, within a range of from 0.7 to 2.5 times of the properly expanding absolute secondary pressure of a nozzle, then the oxygen supplying rate can be greatly changed while maintaining a maximum jet velocity within a nearly predetermined range without greatly changing the distance between the end of the lance and the static bath surface of the molten steel. In the initial period of refining, therefore, the oxygen supplying rate can be increased without greatly increasing the velocity of the jet. Even when the blowing is effected at a high speed, therefore, it is allowed to decrease the amount of generation of dust and spitting per the oxygen supplying rate. At the last period of refining, on the other hand, the oxygen supplying rate can be lowered without greatly decreasing the velocity of the jet. Therefore, since a hot spot of a high temperature is easily obtained and the stirring force is maintained, the decarburization can be advantageously carried out. Here, a maximum value of the absolute secondary pressure of a nozzle during the blowing is set to be not smaller than 1.1 times as great as its minimum value, so that the oxygen supplying rate can be greatly changed. Desirably, furthermore, the absolute secondary pressure of a nozzle is maintained to be from 0.85 to 1.75 times of the properly expanding secondary pressure of nozzle, in order to further narrow the range in which the velocity of the jet varies.

The above-mentioned operation means is entirely to carry out the decarburization by utilizing the improperly expanding jet, that had not been considered so far.

Based on the discovery of the above-mentioned phenomenon, the present inventors have conducted minute study concerning the technical elements in order to carry out proper operation over a range of $P_0/P_{0p}$ of from 0.7 to 2.5, and have derived the following formula (1), $$LG = H_c/(0.016\cdot L^{0.5}) - L \tag{1}$$

where, allowable range of $L$ is $\pm 20\%$, $$H_c = f(P_0/P_{0p})\cdot M_{0p}\cdot(4.2 + 1.1M_{0p}^2)\cdot d_t$$

$$f(X) = \begin{cases} -2.709X^4 + 17.71X^3 - 40.99X^2 + 40.29X - 12.90 & (\text{when } 0.7 < X \leqq 2.1) \\ 0.109X^3 - 1.432X^2 + 6.632X - 6.35 & (\text{when } 2.1 < X < 2.5) \end{cases}$$

LG: distance (mm) between the end of the lance and the static bath surface of molten steel, L: predetermined cavity depth (mm) in the molten steel, $P_0$: absolute secondary pressure (kgf/cm$^2$) of a nozzle, $P_{0p}$: properly expanding absolute secondary pressure (kgf/cm$^2$) of a nozzle, $M_{0p}$: discharge Mach number (–) during the proper expansion, $d_t$: diameter (mm) of a throat portion of the nozzle.

That is, in order to maintain the stirring force (to improve decarburization efficiency) in the steel bath and to prevent the occurrence of spitting, the cavity depth L in the molten steel is set to a predetermined value (target value), in advance, in proportion to an object of blowing so that $L/L_0$ ($L_0$: depth of steel bath) lies within a range of from 0.3 to 0.7, and the distance LG between the end of the lance and the static bath surface of the molten steel is adjusted relying upon the predetermined value and the value $P_0/P_{0p}$.

When the value $P_0/P_{0p}$ is within a range of 0.85 to 1.75, the distance LG is found from the formula (1) by using the upper-limit value of the above value, i.e., by using 1.75, and the absolute secondary pressure $P_0$ of a nozzle, i.e., the oxygen supplying rate is adjusted by this height of nozzle depending upon the state of decarburization. The oxygen supplying rate $F_{02}$ blown from a nozzle having a constant sectional area of an opening varies in proportion to the absolute secondary pressure $P_0$ of a nozzle.

The allowable range of the depth L from the target value is ±20%.

According to the above-mentioned method, when the oxygen supplying rate is set to be smaller than 150 $Nm^3/h/ton$, the refining time is greatly lengthened in a range where the carbon concentration is not smaller than 0.5% where the decarburization oxygen efficiency becomes a maximum during the blowing. When the oxygen supplying rate is set to be larger than 300 $Nm^3/h/ton$, on the other hand, dust and spitting are generated in large amounts. In a range where the carbon concentration is smaller than 0.2% where the decarburization oxygen efficiency starts decreasing, on the other hand, the stirring force becomes insufficient and the decarburization rate decreases when the oxygen supplying rate is set to be smaller than 20 $Nm^3/ton$. When the oxygen supplying rate is set to be larger than 100 $Nm^3/h/ton$, on the other hand, the steel bath tends to be excessively oxidized and iron oxide tends to be formed in the slag.

The above-mentioned method can be put into practice by using a lance having a pipe of one line as shown in FIGS. 2(A) and 2(B) but, preferably, using a lance having gas pipes of 2 to 4 independent lines. This is because, by using the pipe of one line, the amount of change in the flow rate of oxygen gas is 3.57 times the minimum flow rate at the greatest. When the pipes of two or more lines are used, on the other hand, the flow rate of oxygen gas can be changed by more than 3.57 times. When the pipes of five or more lines are used, on the other hand, the structure of the lance becomes so complex that the lance is fabricated with difficulty.

The oxygen lance having gas pipes of two independent lines will be described in further detail with reference to FIGS. 2(C) and 2(D).

The periphery and end of the lance $N_2$ are cooled based on an ordinary water-cooled structure (not shown). Inside of the lance, a central circular gas-supplying pipe 2 and a circumferential circular gas-supplying pipe 1 which are constructed of two lines, which are capable of controlling the flow rate independently each other and are coupled to pipes having a flow rate control valve and a flow meter, respectively are provided. In an embodiment shown in FIGS. 2(C) and 2(D), the central circular gas-supplying pipe 2 is coupled to a central opening 4 through a circular nozzle 2-1, and the circumferential circular gas-supplying pipe 1 is coupled to four circumferential openings 3 through circular nozzles 1—1, the central opening 4 being surrounded by the four circumferential openings 3.

When the average oxygen supplying rate per one opening of central opening 4 is smaller than 50% of the average oxygen supplying rate per one opening of the circumferential openings 3 (condition 1), the oxygen jets through the circumferential openings 3 arrive at the surface of the molten metal in a separate manner like those through an ordinary multi-hole nozzle to create a soft blow. When the average oxygen supplying rate of oxygen gas per one opening of the central opening 4 is larger than 70% of the average oxygen supplying rate per one opening of the circumferential openings 3 (condition 2), the central jet interferes with the jets through the circumferential openings 3, and the jets arrive at the bath surface in a merged form to create a hard blow that corresponds to that of a single-hole lance. In the converter operation method of the present invention, therefore, the ratio of oxygen supplying rates, through the central opening 4 and through the circumferential openings 3, is so adjusted during the blowing as to at least include the processing that satisfies the condition 1 and the processing that satisfies the condition 2, thereby to obtain, as required, a soft blow of the multi-hole lance and a hard blow corresponding to that of a singles-hole lance.

Here, the conditions 1 and 2 are defined because of the following reasons. That is, the present inventors have learned through study that in the lance of the structure used in the present invention, the critical condition for merging or separating the jets through the circumferential openings and the jet through the central opening involving interference, lies in a range where the average oxygen supplying rate per one opening of the central opening is greater than 50% but is smaller than 70% of the average oxygen supplying rate per one opening of the circumferential openings. When the average oxygen supplying rate per one opening of the central opening is smaller than the critical condition, a soft blow is established. Conversely, when the average oxygen supplying rate per one opening of the central opening is greater than the critical condition, a hard blow is established.

Figure 2E:
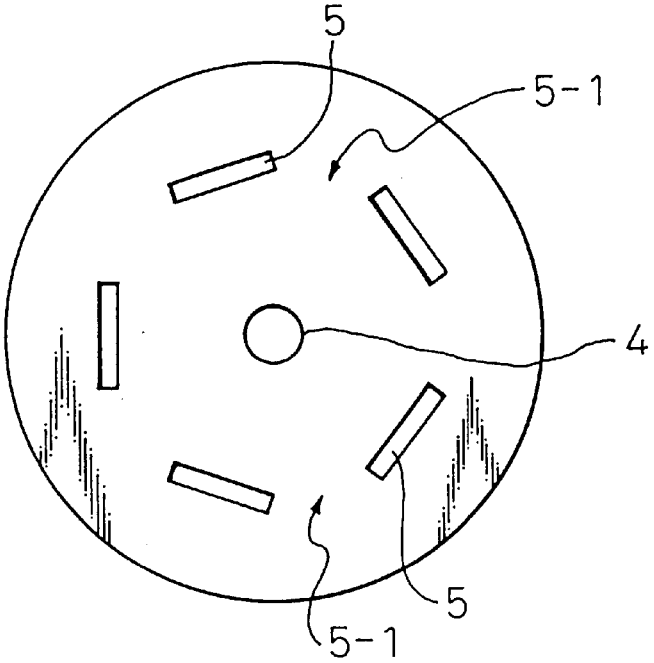
FIG. 2(E) is a plan view of a lance having two lines according to an embodiment of the present invention.

The shape of the circumferential openings needs not be limited to a circular shape but may be of a shape of short s3trips or the like shape as shown in FIG. 2(E). The number of the jets arriving at the surface of the molten metal can be changed into a predetermined number by adjusting the positions, spout angle and number of the spout openings which the flow rate is varied.

Figure 2F:
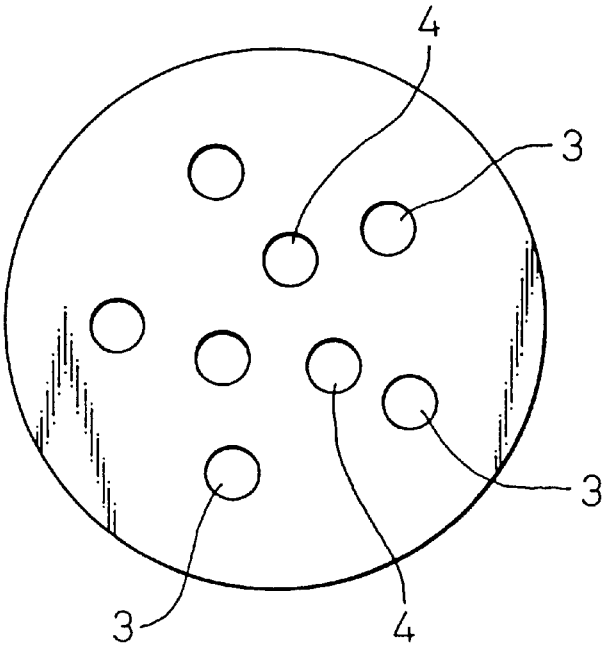
FIG. 2(F) is a plan view of a lance having two lines according to another embodiment of the present invention.
Figure 3A:
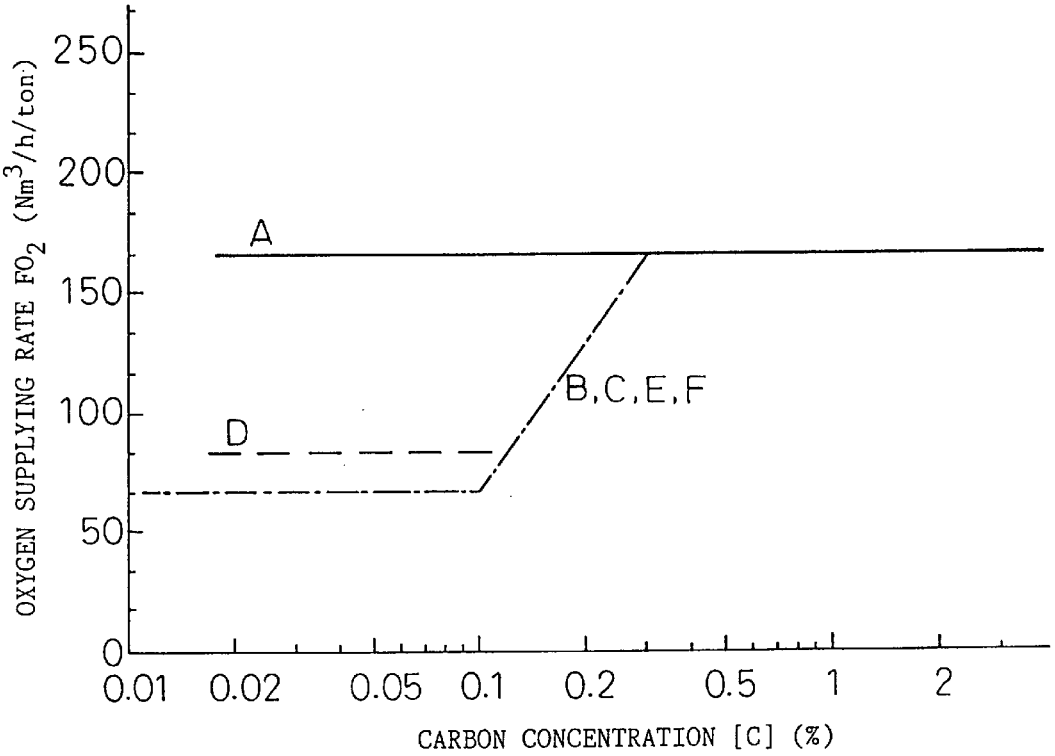
FIGS. 3(A) and 3(B) are diagrams of operation patterns on each of the conditions in the decarburization blowing operation, and illustrate a relationship between the carbon concentration and the oxygen supplying rate.
Figure 3B:
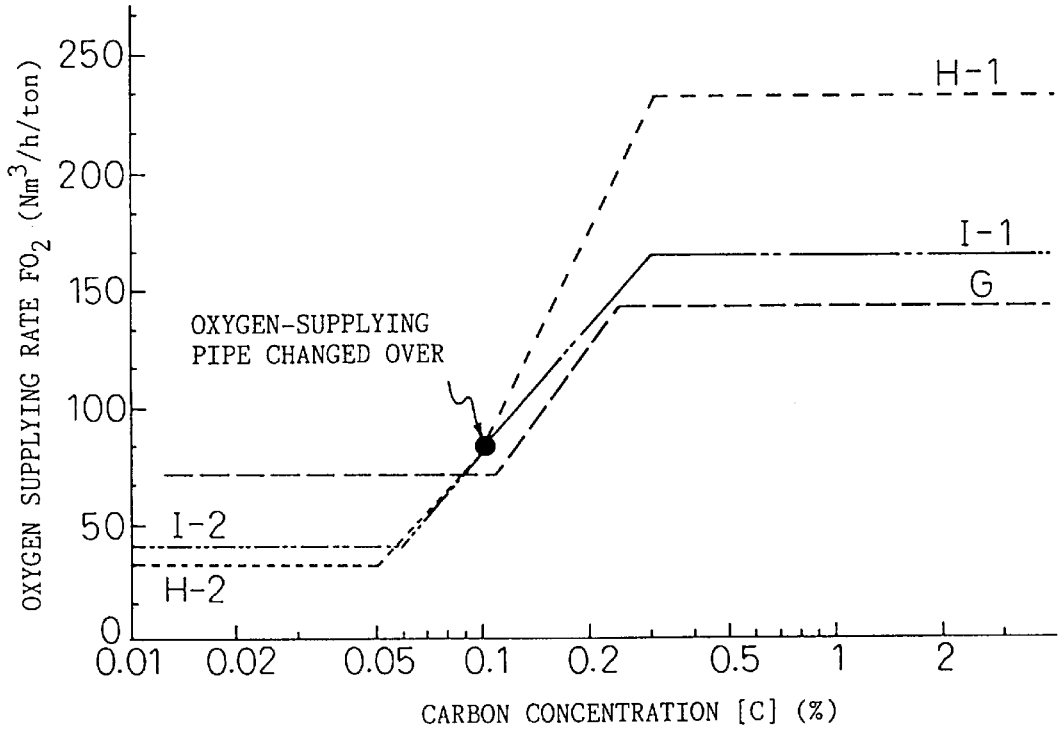
Figure 4A:
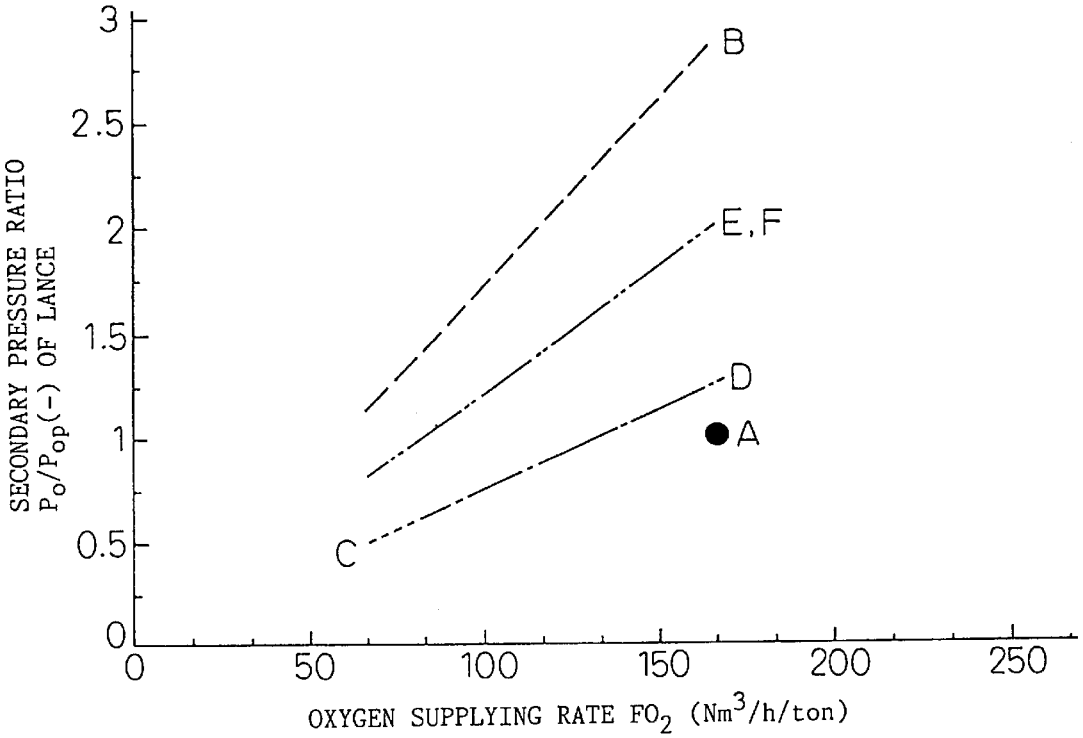
FIGS. 4(A) and 4(B) are diagrams of operation patterns on each of the conditions in the decarburization blowing operation, and illustrate a relationship between the oxygen supplying rate and the secondary pressure ratio of the lance.
Figure 4B:
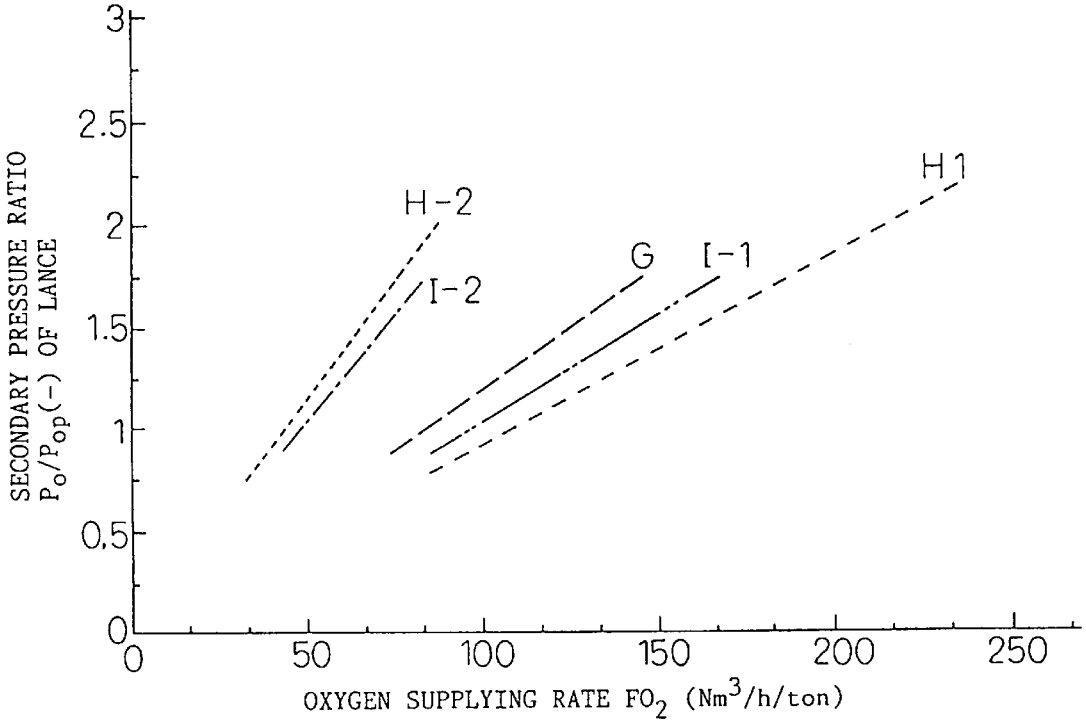
Figure 5A:
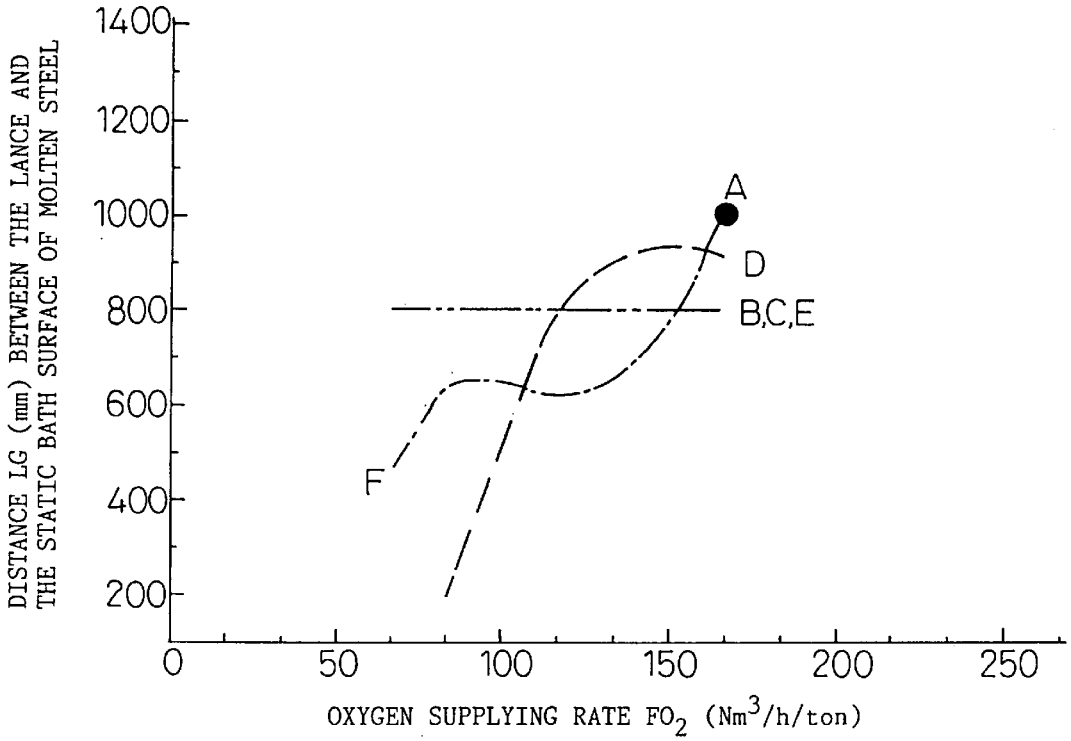
FIGS. 5(A) and 5(B) are diagrams of operation patterns on each of the conditions in the decarburization blowing operation, and illustrate a relationship between the oxygen supplying rate and the distance from the end of the lance to the static bath surface of the molten steel.
Figure 5B:
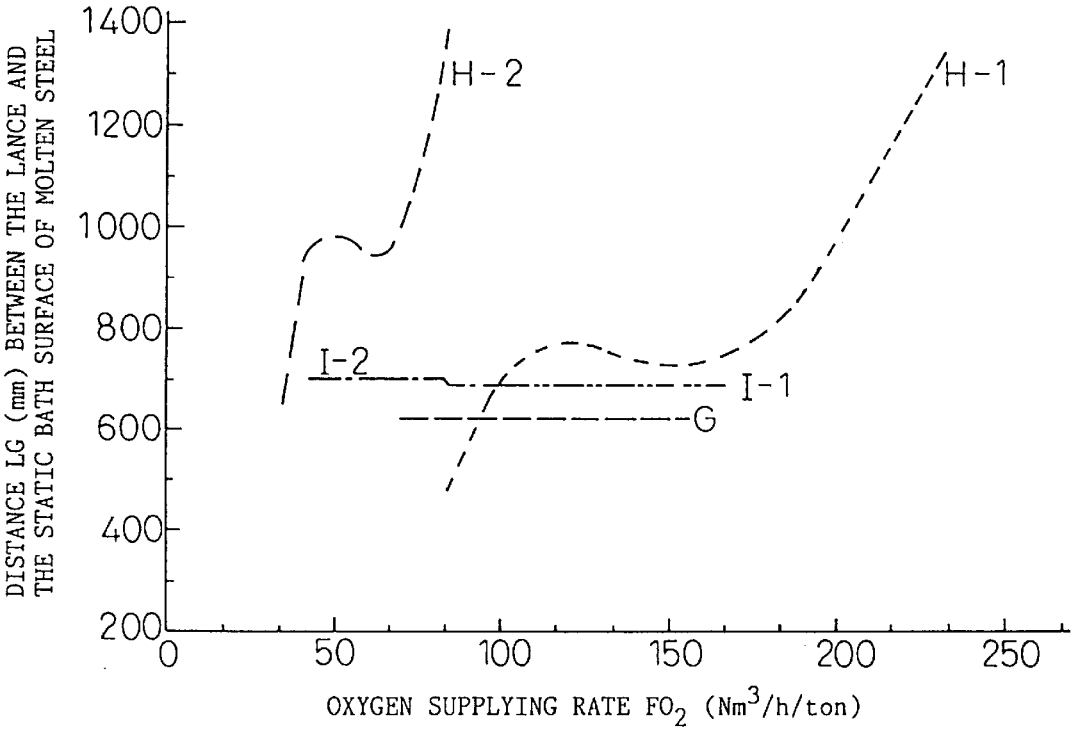
Figure 6A:
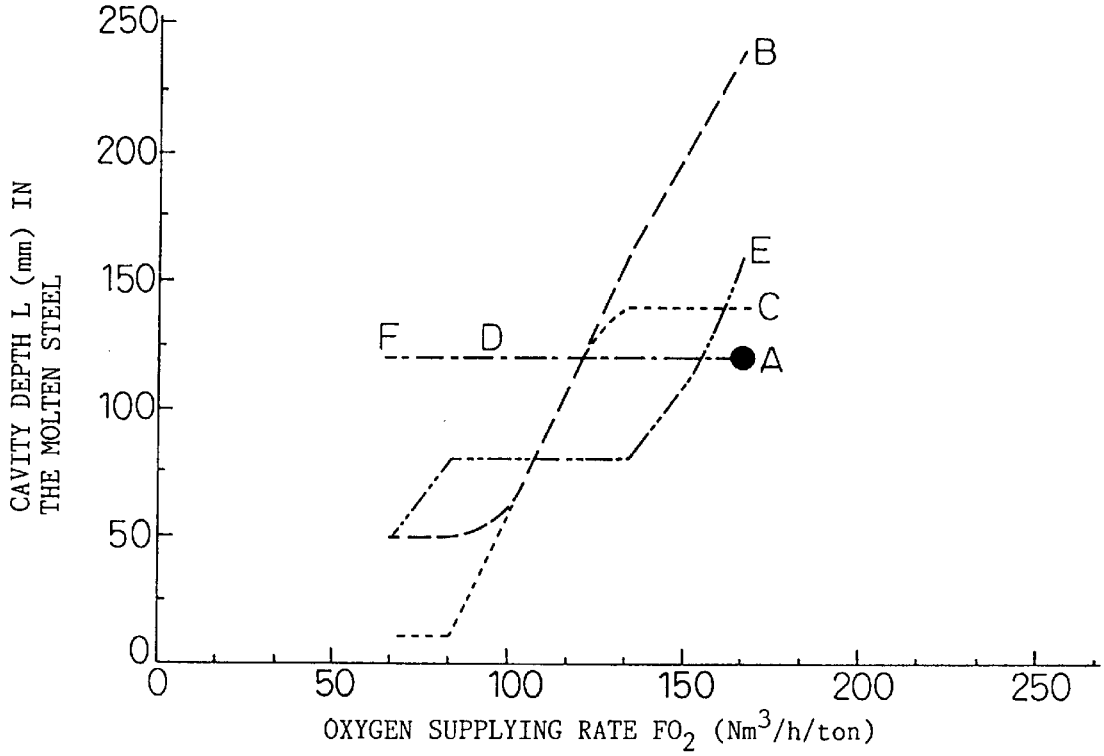
FIGS. 6(A) and 6(B) are diagrams of operation patterns on each of the conditions in the decarburization blowing operation, and illustrate a relationship between the oxygen supplying rate and the depth of the cavity in the molten steel.
Figure 6B:
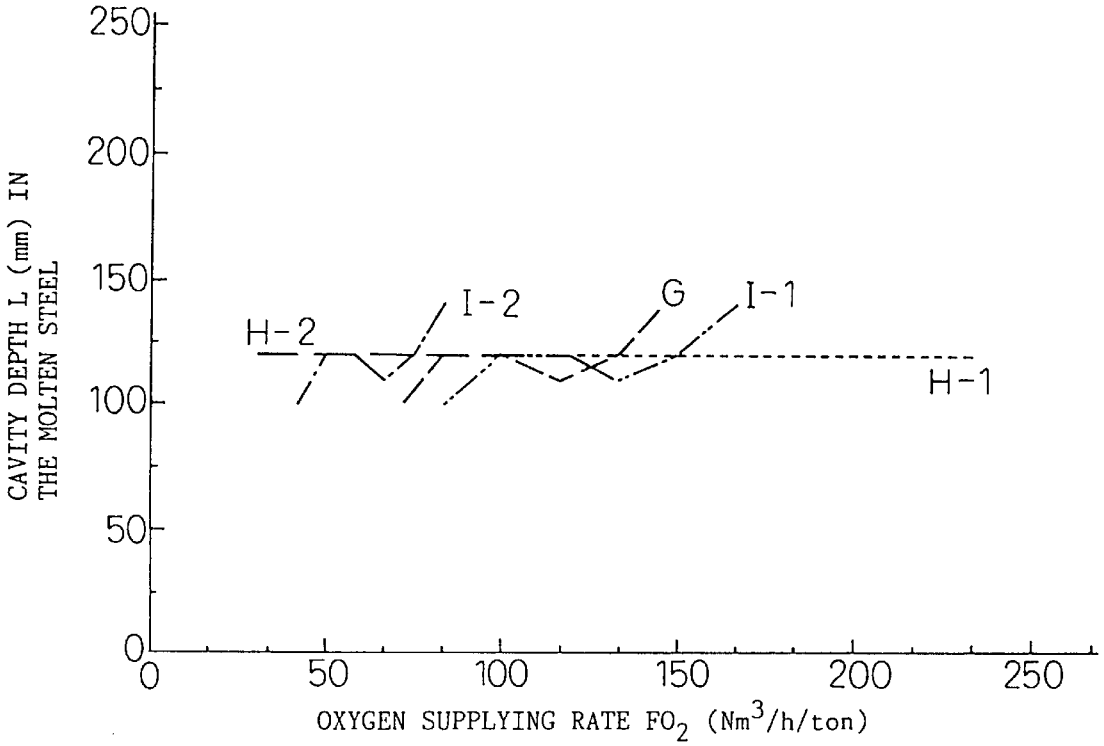

The number of the central opening needs not necessarily be one; i.e., the central openings may be arranged in a separate manner (2 to 6 places) surrounded by the circumferential openings 3 as shown in FIG. 2(F). This is advantageous for merging the jets together particularly when the angle of aperture θ of the circular nozzle 1—1 is as wide as not smaller than 12 degrees with respect to the perpendicular direction and where the jets are less likely to merge together. The condition for merging or separating the jets is evaluated in the same manner as when there is only one opening of the central opening with the ratio of the average oxygen supplying rate per one opening of the circumferential opening to the average oxygen supplying rate per one opening of the central opening as a target.

It is necessary that the circumferential openings are formed in 2 to 10 places and, preferably, in 3 to 6 places having an angle of aperture θ of 6 to 20 degrees with respect to the perpendicular direction. The number of the circumferential openings is specified because of the reason that the soft-blow effect of a multi-hole lance becomes conspicuous when the number of the openings is three or more and that the neighboring jets interfere and merge together irrespective of the flow rate of gas through the central openings when the number of the holes is not smaller than seven. Furthermore, the angle of aperture is specified because the jets from the circumferential openings tend to merge together even when the angle of aperture is smaller than 6 degrees irrespective of the gas flow rate through the central opening. When the angle of aperture is larger than 20 degrees, the jets through the central openings are less likely to be merged. The number of the central openings is limited to be not larger than six. This is because it becomes difficult to realize the water-cooling structure when the number of the central holes are increased in order to accelerate merging the jets and, besides, the effect for merging the jets does not increase even if the number of the central holes becomes larger than seven. An increased effect for merging is obtained when the angle of aperture of the central openings is not larger than a maximum angle of aperture of the circumferential openings.

Therefore, the nozzles having rectangle-like circumferential openings (slit-like nozzle openings) are constituted by an oxygen-supplying pipe having, formed in the end of the top-blown lance, 2 to 10 openings (shielding portions 5-1 are formed in the openings 5 neighboring each other) which are the slit-like nozzles of a concentric polygonal shape having 3 to 16 corners or of a concentric circular shape, and by an oxygen-supplying pipe having 1 to 6 circular nozzle openings 4 on the inside of the slit-like nozzles independently of the above oxygen-supplying pipe. The end of the thus constituted lance is formed as a unitary structure by, for example, pouring a metal into a wood frame for forming slit-like nozzles.

In carrying out the present invention, it is particularly desired to maintain a state where the jets are separated in an intermediate carbon range where the carbon concentration in the molten metal is not smaller than 0.5% by weight and to merge the jets in a low carbon range where the carbon concentration is not larger than 0.2% by weight. That is, when the carbon concentration is not smaller than 0.5% by weight, it is desired that the oxygen supplying rate of the two lines is so adjusted as to satisfy the condition 1 and when the carbon concentration is smaller than 0.2% by weight, it is desired that the oxygen supplying rate of the two lines is so adjusted as to satisfy the condition 2. This is because, in from a high carbon range to an intermediate carbon range where a vigorous decarburization reaction takes place, the decarburization oxygen efficiency can be maintained high, irrespective of the condition for supplying oxygen, and suppressing the generation of dust and spitting by soft blowing is effective in increasing the yield. In a low carbon range where the decarburization efficiency decreases and the combustion of methane becomes a problem, on the other hand, it is desired to maintain a high temperature of the hot spot by hard blowing. In this range, furthermore, since the decarburization rate becomes lower than that of when the carbon concentration is larger than 1%, little dust and spitting are generated even when a relatively hard blow is established.

In the present invention, it is industrially very advantageous to carry out the decarburization operation by lowering the oxygen supplying rate depending upon a decrease in the carbon concentration by utilizing an improperly expanding jet under the hard-blow condition.

The lance having rectangle-like circumferential openings shown in FIG. 2(E) will now be described in further detail with reference to FIGS. 7(A) and 7(B).

Figure 7A:
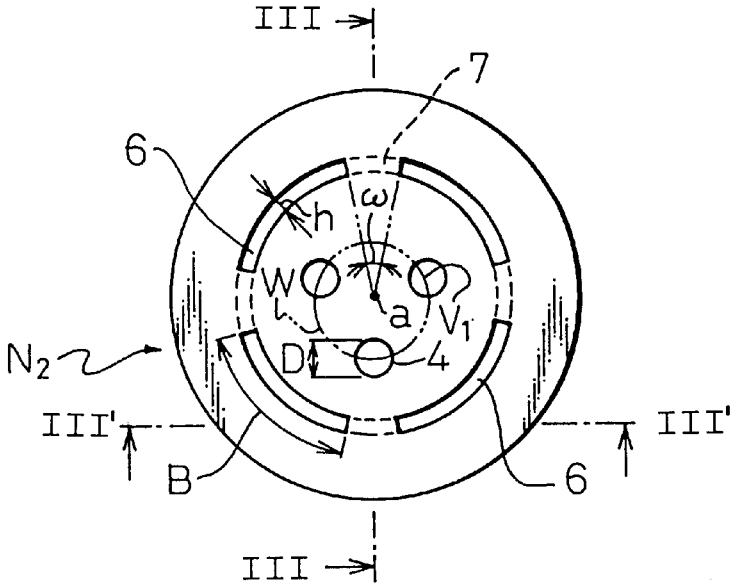
FIG. 7(A) is a plan view of a blowing lance based on the present invention.
Figure 7B:
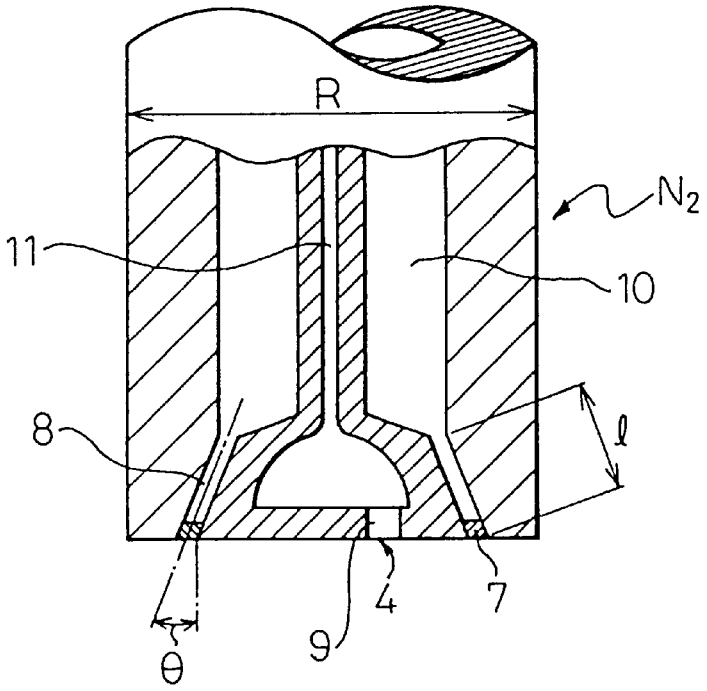
FIG. 7(B) is a sectional view along the line Z—Z of FIG. 7(A)

FIGS. 7(A) and 7(B) illustrate an example in which long and narrow shaped slit-like nozzles 8 having openings 6 of a concentric circular shape separated by shielding plates 7 are formed at the end of the circumferential gas-supplying pipe 10. That is, the lance of this embodiment is constituted by a gas-supplying pipe having 2 to 10 shielding plates arranged in the openings which are slit-like nozzles of a concentric polygonal shape having 3 to 16 corners or of a concentric circular shape in cross section, and by a gas-supplying pipe which is independent from the above pipe and has 1 to 6 circular nozzles on the inside of the slit-like nozzles, the lance body and the end of the lance including the lance center being fastened together via the shielding plates.

The below-mentioned points are important for attenuating the velocity of jets of gas blown from the openings 6.

1) The openings 6 separated by the shielding plates 7 should have a large ratio of the short side (h) to the long side (B), i.e., the openings 6 should be long and narrow shaped spout holes. This is because, the jet has a circumferential length in cross section which is longer than that of the gas blown from the opening 4 of the circular nozzle 9 formed at an end of the central oxygen-supplying pipe 11, and receives a large interaction from the gas other than the jet, and tends to be greatly attenuated immediately after it is blown from the nozzle. This effect is obtained when B/h is larger than 10. When B/h is larger than 225, it becomes difficult to arrange the pipes for cooling the lance with water.

2) The gas blown from the long and narrow shaped opening 6 greatly attenuates immediately after it is blown but thereafter attenuates as the one-seconds power of the distance from the end of the nozzle. On the other hand, the gas blown from the circular opening 4 attenuates little immediately after it is blown but then attenuates as the first power of the distance from the end of the nozzle. In order to increase the subsequent attenuation while maintaining the characteristics of 1) above that the jet greatly attenuates immediately after it is blown, therefore, it is necessary to change the jet blown from the nozzle from a long and narrow shape to a circular shape in cross section. When the lance diameter is R (mm), this is done by selecting (B·h)/R to be smaller than 4. When (B·h)/R is smaller than 0.4, it become, difficult to fabricate the nozzle while maintaining precision.

Figure 9A:
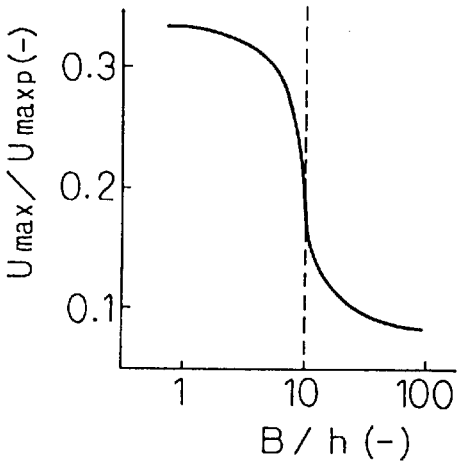
FIG. 9(A) is a diagram illustrating a relationship between a ratio $U_{max}/U_{maxP}$ of a maximum jet velocity of during the proper expansion to a maximum jet velocity and a ratio B/h of a length h of the short side to a length B of the long side of the opening at the end of the long and narrow shaped nozzle.
Figure 9B:
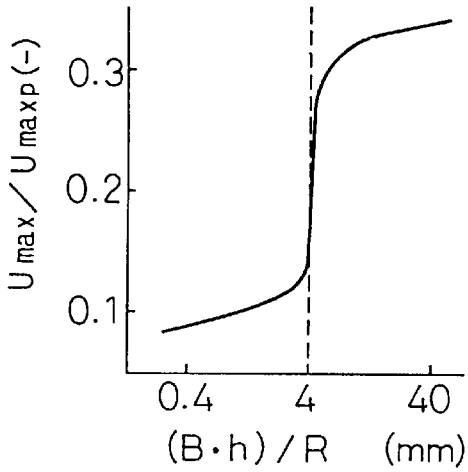
FIG. 9(B) is a diagram illustrating a relationship between the ratio $U_{max}/U_{maxP}$ and a ratio (B·h)/R of a diameter R of the lance to the length B of the long side and the length h of the short side of the opening at the end of the long and narrow shaped nozzle.

FIGS. 9(A) and 9(B) illustrate the results of study of the jet characteristics, from which it will be understood that the velocity of the jet is attenuated to the greatest extent when the above two conditions are satisfied.

3) In the case of a multi-hole nozzle having a plurality of nozzles satisfying the above-mentioned conditions 1) and 2), it is important not to merge the jets from the neighboring nozzles together. One of the conditions for this is to maintain an angle ω subtended by a central point a of the lance and points of the two neighboring nozzle openings closest to each other to be from 10 to 60 degrees. When this angle ω is smaller than 10 degrees, the jets expanded in the direction of the long side merge together and are little attenuated after they have merged. When the angle ω is larger than 60 degrees, on the other hand, the opening area becomes so small that the gas flow rate is not sufficiently is maintained. As will be described later, furthermore, the individual nozzle openings are separated from each other by shielding plates having a limited thickness. When the angle ω is larger than 60 degrees, the shielding plates have increased areas and receive heat in an increased amount: and are melted and damaged.

Figure 8A:
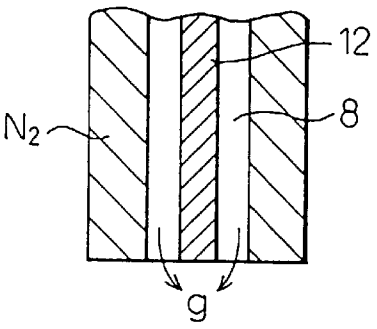
FIGS. 8(A) to 8(D) are sectional views along the line Z'—Z' of FIG. 7(A), and illustrate structures of the long and narrow shaped nozzles and the shielding plates.
Figure 8B:
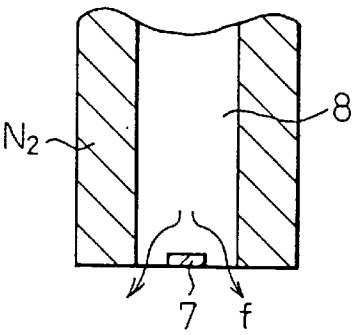

4) In order to prevent the merging, furthermore, the region which contains spout holes of a shape as defined in 1) and 2) above is limited to the portions of nozzle openings only. That is, even if the appearance of the nozzle opening is the same as that of FIG. 7(A), when the whole nozzle 8 on a plane corresponding to the cross section of line Z'—Z' of FIG. 7(A) is designed to acquire a cross-sectional shape as defined by 1) and 2) above (see FIG. 8(A)), the flow of gas is rectified in the gas-supplying pipe, whereby a flow g is formed immediately after the outlet to leave and spread from the center of the nozzle opening as shown in FIG. 8(A), and the jets are merged due to this flow. As shown in FIG. 7(B) and FIG. 8(B), on the other hand, when the nozzle is formed in a long and narrow shape having a simple concentric polygonal shape or a concentric circular shape in cross section and when thin shielding plates are arranged at the end, so that the nozzle ends only will acquire a cross-sectional shape as defined in 1) and 2) above, the gas flow is disturbed just before the opening, and a flow f is formed heading toward the center of the nozzle opening. Immediately after being blown out, therefore, the flow does not spread to separate away from the center of the nozzle opening. The thickness of the shielding plate must be smaller than 0.3 l mm in relation to the nozzle length l (mm)(see FIG. 7(B)). When the thickness is greater than this value, the effect by a turbulent flow is not obtained just before the outlet. The lower limit of the thickness is determined depending upon the strength of the shielding plates and should substantially be not smaller than 1 mm.

Figure 8C:
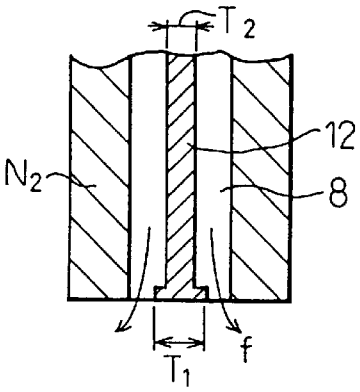

5) Similarly, as shown in FIG. 8(C), the merging can be effectively prevented by selecting the width ($T_1$) of the shielding plate 7 or 12 of a portion of from 0.01 l to 0.3 l mm from the end of the lance in relation to the nozzle length l in the circumferential direction of the nozzle, to be 1.5 to 4 times as great as the width ($T_2$) of other portions. Even in this case, the flow of gas is disturbed just before the opening, and a flow f is formed heading toward the center of the nozzle opening. Therefore, the flow does not much spread to separate away from the center of the nozzle opening just after being blown out. By utilizing the portion $T_2$, furthermore, the cooling water pipe of the lance can be easily arranged.

Here, when a portion spreading from $T_2$ to $T_1$ is greater than 0.3 l mm, the effect by a turbulent flow is not obtained just before the outlet. When this portion is smaller than 0.01 l mm, the strength of the portion of the width $T_1$ becomes small, causing a problem from the standpoint of life of the lance. When the ratio ($T_1/T_2$) of $T_2$ to $T_1$ is smaller than 1.5, the effect by a turbulent flow is not obtained just before the outlet. When this ratio is larger than 4 times, $T_2$ becomes so small that the cooling water pipe of the lance cannot be easily arranged by utilizing the portion $T_2$.

Figure 8D:
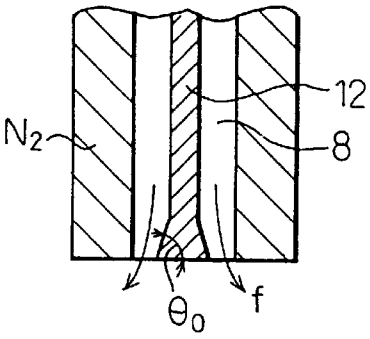

6) As shown in FIG. 8(D), furthermore, the merging can be effectively prevented by decreasing the width of the shielding plate of a portion of from 0.01 l to 0.3 l mm from the end of the lance in relation to the nozzle length l in the circumferential direction of the nozzle, at an angle ($\omega_0$) of 10 to 80 degrees from the end of the nozzle toward the inside of the nozzle relative to the plane of the end of the lance. This is because, a flow f is formed in the slit heading toward the center of the nozzle opening, and the flow does not much spread from the center of the nozzle opening immediately after being blown out. Here, when the angle ($\omega_0$) is set to be greater than 80 degrees, the flow f is not formed. When the angle ($\omega_0$) is set to be smaller than 10 degrees, on the other hand, the shielding plate at the end loses strength, causing a problem of the life of the lance. When the length of the decreasing portion is smaller than 0.01 l mm, the flow f is not formed to a sufficient degree. When the length of the decreasing portion is greater than 0.3 l mm, the effect by the turbulent flow is not obtained just before the outlet.

The nozzle has a concentric polygonal or circular slit in cross section, the concentric polygon having 3 to 16 corners. This is because a shape with two corners does not exist and, on the other hand, a polygon having more than 16 corners involves difficulty in fabrication. When the number of the shielding plates is smaller than two, the long side (B) becomes very large. When the number of the shielding plates is larger than 10, on the other hand, the long side (B) becomes very small. In either case, therefore, B/h and B·h do not lie within proper ranges, and the effects of the invention are not obtained.

In the present invention, furthermore, the lance body $N_2$ and the end of the lance including a center point a are secured together via the shielding plates 7, and the center point a does not move up and down relative to the lance body $N_2$. Unlike the prior art, therefore, there is no need to provide a complex drive mechanism in which the end of the lance including the center point a is formed as a core separately from the lance body, and the core only is moved up and down. Therefore, the lance is constructed in a simple structure, which is a great advantage.

When the blowing is effected in the converter in a state having such a suitable shape, such a soft blow is established that could not be accomplished by the conventional circular multi-hole lance, and a metallurgical effect is obtained while greatly suppressing the generation of dust and splash. This is because, since the soft blow is established by the present invention, the generation of material (splash dust) which is caused by spitting the molten steel through a kinetic energy of the gas, the kinetic energy is obtained when the gas blown from the nozzle impinges on the bath surface, which is one of the causes of producing dust, can be avoided.

When the soft blow is continued up to the range where the carbon concentration is smaller than 0.5%, however, much iron is oxidized. In such an intermediate carbon concentration range, therefore, the jet must be intense enough to establish a hard blow. For this purpose, the gas must be supplied from the circular nozzles at the center of the lance, and these jets and the jets from the slit-like nozzles must be merged together. In this case, as described earlier, the average oxygen supplying rate per one opening of the central opening 4 is set to be not smaller than 70% of the average oxygen supplying rate per one opening of the circumferential openings, so as to be interfered by the jets through the circumferential openings 6, so that the merged stream establishes a hard blow that corresponds to the one established by the single-hole lance.

When the jets blown out from the long and narrow shaped slit-like nozzles and the jets blown from the circular nozzles are merged together, a single jet is established due to their own strong attractive force. Here, the central portion of the jet creates a hard blow maintaining the characteristics of the circular nozzles but the jets of the peripheral portion of the above jet tend, to spread due to the characteristics of the jets blown from the long and narrow shaped slit-like nozzles, so that the area of the hot spot increases. Accordingly, dust is generated only in small amounts despite the hard blow being established.

Here, in order to maintain an opening area large enough for supplying large amounts of the oxygen gas while satisfying the conditions B/h and (B·h)/R and establishing a soft blow to its maximum degree relying upon the long and narrow shaped slit-like nozzles, it becomes necessary to decrease the short side h of the opening 6 by increasing the average diameter of the concentric circle or by increasing the average diameter of a circle circumscribing the concentric polygon. For this purpose, it is desired to arrange the long and narrow shaped slit-like nozzles on the outer side of the lance and to arrange circular nozzles on the inner side. When the number of the circular nozzles is denoted by n and the total area of the slit-like nozzles (four slit nozzles in FIG. 7(A)) in the end is denoted by A ($mm^2$), the diameter D (mm) of the circular nozzle in the end is given by the following formula, $$D=[4\alpha\times A/(\pi\times n)]^{1/2} \quad (5)$$

and wherein it is desired that $\alpha$ is from 0.05 to 0.5.

When the circular nozzles are formed in a plural number, it is desired that the circular nozzles are so arranged that an equilateral shape (equilateral triangle in FIG. 7(A)) is formed by connecting the center points of the circular nozzles by straight lines on the lower end surface of the lance, that the geometrical center of gravity of the equilateral shape comes into agreement with the center a of the lance, and that the total length v of partial circumferences $V_1$ passing through the openings at the end of the circular nozzles, is 0.3 to 0.7 in terms of V/W relative to the circumferential length W of a circle circumscribing the equilateral shape formed by coupling the center points of the circular nozzles by straight lines.

Figure 10A:
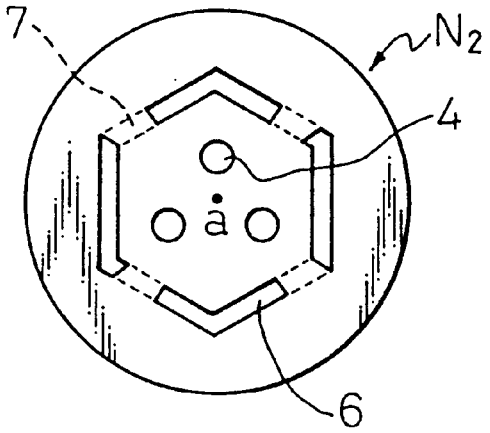
FIGS. 10(A) to 10(C) are plan views of blowing lances having long and narrow shaped nozzles of concentric polygonal shapes of the present invention.
Figure 10B:
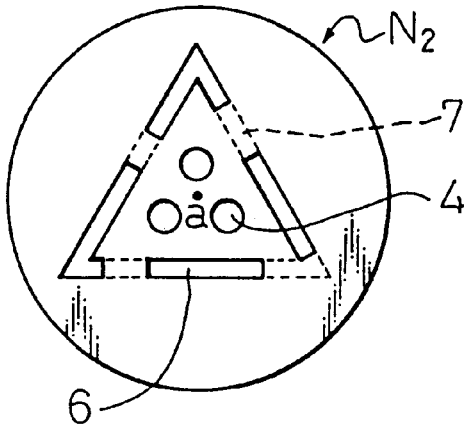
Figure 10C:
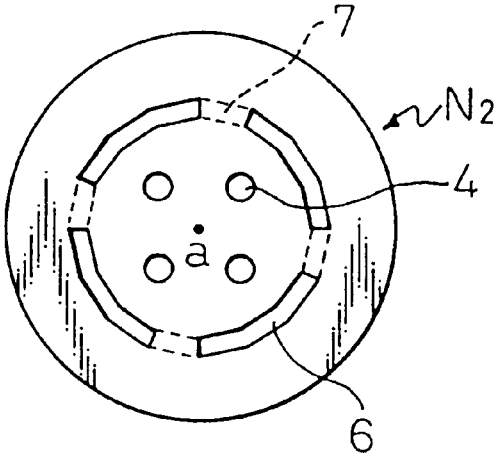

The openings 6 of the slit-like nozzles 8 may be formed in polygonal shapes as shown in FIGS. 10(A) to 10(C).

When the blowing is effected in the converter in a state having such a suitable shape, a metallurgical effect that the dust and splash are greatly decreased, as described above, is obtained. According to the present invention, furthermore, the soft blowing is established in a state where the height of lance is greatly lowered compared to that of the ordinary circular multi-hole nozzle. Therefore, the post combustion rate does not so increase as to cause the refractories to be damaged. Besides, good heat transfer is obtained since the post combustion takes place in a state where the height of the lance is low.

When the refining is effected by utilizing the improperly expanding jet of the invention for the circular nozzles at the center of the lance and by lowering the oxygen supplying rate accompanying a decrease in the carbon concentration, dust is generated in decreased amounts owing to the soft blowing from the initial period to the intermediate period of blowing. This becomes more meaningful in the last period of blowing since the tendency of peroxidation is suppressed by the hard blow and by adjusting the oxygen supplying rate.

When the blowing is effected by using a lance having long and narrow shaped slit-like nozzles, the distance LG between the end of the lance and the static bath surface of the molten steel may be found in compliance with the following formula (6) instead of the above-mentioned formula (1) in order to more reliably adjust the cavity depth L in the molten steel during the blowing.

$$LG = H_d / (0.016 \cdot L^{0.5}) - L \tag{6}$$

$$H_d = f(P_0 / P_{0p}) \cdot M_{0p} \cdot [(4.2 + 1.1 M_{0p}^2) \cdot \beta]^{1/2} \cdot h$$

$$f(X) = \begin{cases} 0.521X^4 - 2.422X^3 + 3.372X^2 - 0.644X + 0.28 & (\text{when } 0.2 < X \leqq 2.1) \\ -0.224X^3 + 2.14X^2 - 6.014X + 6.71 & (\text{when } 2.1 < X < 4.2) \end{cases}$$

$$\beta = 9.655 \cdot (B / h)^{0.87}$$

$\beta = 9.655 \cdot (B/h)^{0.87}$

L: predetermined cavity depth (mm) in the molten steel,

LG: distance (mm) between the end of the lance and the static bath surface of the molten steel, $P_0$: absolute secondary pressure (kgf/cm$^2$) of nozzle, $P_{0p}$: properly expanding absolute secondary pressure (kgf/cm$^2$) of nozzle, $M_{0p}$: discharge Mach number (–) during the proper expansion, h: length (mm) of the short side of the long and narrow shaped nozzle opening, B: length (mm) of the long side of the long and narrow shaped nozzle opening.

During the period of blowing for decarburization, inert gases such as argon, CO, $CO_2$ may be blown, as required, together with the oxygen gas through the central nozzles or the circumferential nozzles. This makes it possible to prevent an accident such as clogging of the nozzle openings due to blowing out of the oxygen gas.

Concretely described below is a blowing method carried out in the ranges for decarburization reaction by using lances of two lines that can be controlled independently each other. In this example, the inert gas is supplied from the circumferential gas-supplying pipe in the last period of blowing.

In the decarburization reaction range in which the carbon concentration is not smaller than 0.5% by using the above-mentioned lances of the two lines, oxygen is supplied through the slit-like or circular nozzle coupled to the circumferential gas-supplying pipe and is supplied through the circular nozzle coupled to the central gas-supplying pipe such that $L/L_0$ is from 0.5 to 0.3, and the oxygen supplying rate per one opening of the circular nozzle coupled to the central gas-supplying pipe is selected to be not larger than 50% of the oxygen supplying rate per one opening of the slit-like or circular nozzle coupled to the circumferential gas-supplying pipe, so that the total oxygen supplying rate through the two supplying pipes is within a range of from 150 to 300 Nm$^3$/h/ton. In a range where the carbon concentration is from 0.2 to 0.5%, oxygen is supplied through the slit-like or circular nozzle coupled to the circumferential gas-supplying pipe and is supplied through the circular nozzle coupled to the central gas-supplying pipe such that $L/L_0$ is from 0.5 to 0.7, and the oxygen supplying rate per one opening of the circular nozzle coupled to the central gas-supplying pipe is selected to be not smaller than 70% of the oxygen supplying rate per one opening of the slit-like or circular nozzle coupled to the circumferential gas-supplying pipe, so that the total oxygen supplying rate from the two supplying pipes is within a range of from 100 to 200 Nm$^3$/h/ton. In the last period of blowing in which the carbon concentration is from 0.01 to 0.2%, one or two or more kinds of nitrogen, carbon dioxide, argon and carbon monoxide are supplied through the slit-like or circular nozzles coupled to the circumferential gas-supplying pipe in amounts of from 15 to 30 Nm$^3$/h/ton and, at the same time, oxygen is supplied through the circular nozzles coupled to the central gas-supplying pipe in an amount of from 20 to 100 Nm$^3$/h/ton. In order that $L/L_0$ is in a range of from 0.5 to 0.7 at each of the above oxygen supplying rates, in the range where the carbon concentration is from 0.1 to 0.2%, the absolute secondary pressure of nozzle $P_0/P_{0p}$ is set to be from 1.75 to 2.5, in the range where the carbon concentration is from 0.05 to 0.1%, $P_0/P_{0p}$ is set to be from 1 to 1.75 and in the range where the carbon concentration is from 0.05 to 0.01%, $P_0/P_{0p}$ is set to be from 1 to 0.7.

EXAMPLES

Example 1

Decarburization testing was conducted on nine conditions A, B, C, D, E, F, G, H and I by using a top- and bottom-blown converter having an inner diameter of about 2.1 m and by introducing 6 tons of molten pig-iron. The depth $L_0$ of the steel bath was about 240 mm. From the testing previously conducted by using this converter, the cavity depth L in the molten steel was presumed to be about 120 mm. On any condition, nitrogen was used as a bottom-blow gas at a rate of 100 Nm$^3$/h. Immediately after the start of refining, furthermore, lime was thrown in an amount of 130 kg so that the basicity (weight ratio of $SiO_2$ and CaO) of the slag was about 3.5. Design values of the nozzles on each of the conditions are shown in Table 1, and the ends of the lances are schematically diagramed in FIGS. 2(A) to 2(D).

On the condition A, oxygen was supplied at a rate of 167 $Nm^3/h/ton$, the ratio $P_0/P_{0p}$ of the properly expanding absolute secondary pressure to the absolute secondary pressure of the nozzle was set to be 1, the distance was set to be 1000 mm between the end of the lance and the static bath surface of the molten steel, the cavity depth in the molten steel was set to be 120 mm, and the refining was conducted without changing the operation pattern.

On the condition B, the oxygen supplying rate was changed from 167 $Nm^3/h/ton$ to 67 $Nm^3/h/ton$ depending upon the carbon concentration, and the ratio $P_0/P_{0p}$ of the properly expanding absolute secondary pressure to the absolute secondary pressure of the nozzle was changed from 2.86 to 1.14 correspondingly. A maximum ratio $P_0/P_{0p}$ on this condition was greater than the upper limit of the range of $P_0/P_{0p}$ of the present invention. Furthermore, since the distance between the end of the lance and the static bath surface of the molten steel was set to be 800 mm constant, the cavity depth in the molten steel has changed from 240 mm to 55 mm depending upon a change in the oxygen supplying rate. The cavity depth (L/predetermined value: 55/120 to 240/120=0.46 to 2.00) in the molten steel on this condition lay outside the scope of the present invention.

On the condition C, the oxygen supplying rate was changed from 167 $Nm^3/h/ton$ to 67 $Nm^3/h/ton$ depending upon the carbon concentration, and the ratio $P_0/P_{0p}$ of the properly expanding absolute secondary pressure to the absolute secondary pressure of the nozzle was changed from 1.25 to 0.50 correspondingly. A minimum ratio $P_0/P_{0p}$ on this condition was smaller than the lower limit of the range of $P_0/P_{0p}$ of the present invention. Furthermore, since the distance between the end of the lance and the static bath surface of the molten steel was set to be 800 mm constant, the cavity depth in the molten steel has changed from 140 mm to 10 mm depending upon a change in the oxygen supplying rate. The cavity depth (L/predetermined value: 10/120 to 140/120=0.08 to 1.17) in the molten steel on this condition lay outside the scope of the present invention.

On the condition D, the oxygen supplying rate was changed from 167 $Nm^3/h/ton$ to 83 $Nm^3/h/ton$ depending upon the carbon concentration, and the ratio $P_0/P_{0p}$ of the properly expanding absolute secondary pressure to the absolute secondary pressure of the nozzle was changed from 1.25 to 0.625 correspondingly. A minimum ratio $P_0/P_{0p}$ on this condition was smaller than the lower limit of the range of $P_0/P_{0p}$ of the present invention. Furthermore, the distance between the end of the lance and the static bath surfaces of the molten steel was changed from 900 to 200 mm depending upon the change in the oxygen supplying rate, so that the cavity depth in the molten steel was within ±20% of the predetermined value of 120 mm.

On the condition E, the oxygen supplying rate was changed from 167 $Nm^3/h/ton$ to 67 $Nm^3/h/ton$ depending upon the carbon concentration, and the ratio $P_0/P_{0p}$ of the properly expanding absolute secondary pressure to the absolute secondary pressure of the nozzle was changed from 2.00 to 0.80 correspondingly. The ratio $P_0/P_{0p}$ on this condition was within the range of $P_0/P_{0p}$ of the present invention. Furthermore, since the distance between the end of the lance and the static bath surface of the molten steel was set to be 800 mm constant, the cavity depth in the molten steel has changed from 160 mm to 50 mm depending upon a change in the oxygen supplying rate. The cavity depth (L/predetermined value: 50/120 to 160/120=0.42 to 1.33) in the molten steel on this condition lay outside the scope of claim 2 of the present invention.

On the condition F, the oxygen supplying rate was changed from 167 $Nm^3/h/ton$ to 67 $Nm^3/h/ton$ depending upon the carbon concentration, and the ratio $P_0/P_{0p}$ of the properly expanding absolute secondary pressure to the absolute secondary pressure of the nozzle was changed from 2.00 to 0.80 correspondingly. The ratio $P_0/P_{0p}$ on this condition was within the range of $P_0/P_{0p}$ of the present invention. Furthermore, the distance between the end of the lance and the static bath surface of the molten steel was changed from 997 mm to 454 mm depending upon a change in the oxygen supplying rate, so that the cavity depth in the molten steel was within ±20% of the predetermined value of 120 mm.

On the condition G, the oxygen supplying rate was changed from 145 $Nm^3/h/ton$ to 72 $Nm^3/h/ton$ depending upon the carbon concentration, and the ratio $P_0/P_{0p}$ of the properly expanding absolute secondary pressure to the absolute secondary pressure of the nozzle was changed from 1.74 to 0.85 correspondingly. The ratio $P_0/P_{0p}$ on this condition was within the most desirable range of $P_0/P_{0p}$ of the present invention. Furthermore, since the distance between the end of the lance and the static bath surface of the molten steel was set to be 631 mm constant, the cavity depth of the molten steel has changed from 140 mm to 100 mm depending upon a change in the oxygen supplying rate. The cavity depth (L/predetermined value: 100/120 to 140/120=0.83 to 1.17) in the molten steel on this condition was within the range of the present invention. On this condition, there was no need to continuously control the distance between the end of the lance and the static bath surface of the molten steel, and the operation was easy.

On the condition H, the oxygen supplying rate was changed from 233 $Nm^3/h/ton$ to 33 $Nm^3/h/ton$ depending upon the carbon concentration. On this condition, use was made of a lance having oxygen-supplying pipes of two lines. First, the oxygen supplying rate through the gas pipe of the first line was changed from 233 $Nm^3/h/ton$ to 83 $Nm^3/h/ton$, and the ratio $P_0/P_{0p}$ of the properly expanding absolute secondary pressure to the absolute secondary pressure of the nozzle was changed from 2.15 to 0.77 correspondingly. Furthermore, the distance between the end of the lance and the static bath surface of the molten steel was changed from 1053 mm to 468 mm depending upon a change in the oxygen supplying rate, and the cavity depth in the molten steel was adjusted to be within ±20% of the predetermined value of 120 mm. Next, the gas pipe was changed over to the gas pipe of the second line, the oxygen supplying rate was changed from 83 $Nm^3/h/ton$ to 33 $Nm^3/h/ton$, and the ratio $P_0/P_{0p}$ of the properly expanding absolute secondary pressure to the absolute secondary pressure of the nozzle was changed from 1.92 to 0.77 correspondingly. Furthermore, the distance between the end of the lance and the static bath surface of the molten steel was changed from 1363 mm to 624 mm depending upon a change in the oxygen supplying rate, and the cavity depth in the molten steel was adjusted to be within ±20% of the predetermined value of 120 mm. The ratio $P_0/P_{0p}$ on this condition was within the range of $P_0/P_{0p}$ of the present invention.

On the condition I, the oxygen supplying rate was changed from 167 $Nm^3/h/ton$ to 42 $Nm^3/h/ton$ depending upon the carbon concentration. On this condition, use was made of a lance having oxygen-supplying pipes for two lines. First, the oxygen supplying rate through the gas pipe of the first line was changed from 167 $Nm^3/h/ton$ to 83 $Nm^3/h/ton$, and the ratio $P_0/P_{0p}$ of the properly expanding absolute secondary pressure to the absolute secondary pressure of the nozzle was changed from 1.74 to 0.87 correspondingly. The ratio $P_0/P_{0p}$ on this condition was within the most desired range of $P_0/P_{0p}$ of the present invention. Since the distance between the end of the lance and the static bath surface of the molten steel was set to be 685 mm which was nearly constant, the cavity depth in the molten steel has changed from 140 mm to 100 mm depending upon a change in the oxygen supplying rate. The cavity depth (L/predetermined value: 100/120 to 140/120=0.83 to 1.17) in the molten steel was within the range of the present invention. Next, the gas pipe was changed over to the gas pipe of the second line, the oxygen supplying rate was changed from 83 $Nm^3$/h/ton to 42 $Nm^3$/h/ton, and the ratio $P_0/P_{0p}$ of the properly expanding absolute secondary pressure to the absolute secondary pressure of the nozzle was changed from 1.74 to 0.87 correspondingly. The ratio $P_0/P_{0p}$ was within the most desired range of $P_0/P_{0p}$ of the present invention. Since the distance between the end of the lance and the static bath surface of the molten steel was set to be 700 mm which was nearly constant, the cavity depth in the molten steel has changed from 140 mm to 100 mm depending upon a change in the oxygen supplying rate. The cavity depth (L/predetermined value: 100/120 to 140/120=0.83 to 1.17) in the molten steel was within the range of the present invention. On this condition, there was no need to continuously control the distance between the end of the lance and the static bath surface of the molten steel, and the operation was easy.

Details of operation patterns on the above-mentioned conditions are shown in Table 2 and in FIGS. 3(A), 3(B), 4(A), 4(B), 5(A), 5(B), 6(A) and 6(B). Symbols A to I-2 in the drawings correspond to the symbols of the conditions. The operation pattern was executed by estimating the carbon concentration during the refining relying upon a dynamic estimation model. Results of testing on each of the conditions are shown in Table 3.

TABLE 1

| Section | Condition | $P_{0p}$ (Kgf/$cm^2$) | $F_{02p}$*1 ($Nm^3$/h/ton) | n*1 (–) | $d_1$*1 (mm) | $\Sigma S_1$*1 ($mm^2$) |
|---|---|---|---|---|---|---|
| Comparative Example | A | 9.0 | 167 | 4 | 7.79 | 190.6 |
| Comparative Example | B | 4.5 | 58 | 4 | 6.50 | 132.9 |
| Comparative Example | C | 9.0 | 133 | 4 | 6.97 | 152.4 |
| Comparative Example | D | Same lance nozzles as those of condition C | | | | |
| This invention | E | 6.0 | 83 | 4 | 6.74 | 142.6 |
| This invention | F | Same lance nozzles as those of condition D | | | | |
| This invention | G | Same lance nozzles as those of condition D | | | | |
| This invention*2 | H-1 | 6.0 | 108 | 4 | 7.68 | 185.4 |
| | H-2 | 6.0 | 43 | 1 | 9.72 | 74.2 |
| This invention*2 | I-1 | 6.0 | 96 | 4 | 7.24 | 164.7 |
| | I-2 | 6.0 | 48 | 2 | 7.24 | 82.3 |

(Note)
*1$P_{0p}$: properly expanding absolute secondary pressure of nozzle (kgf/$cm^2$),
$F_{02p}$: oxygen supplying rate during the proper expansion ($Nm^3$/h/ton),
n: number of nozzle holes (–),
$d_1$: diameter of nozzle throat portion (mm),
$\Sigma S_1$: total area of nozzle throat portions ($mm^2$).
*2On the conditions H and I, use was made of a lance having gas pipes of two lines. Therefore, operation patterns of nozzles of these lines were also listed.

TABLE 2

| Section | Condition | $F_{02}$*1 ($Nm^3$/h/ton) | $P_0/P_{0p}$*1 (–) | LG*1 (–) | L*1 (mm) |
|---|---|---|---|---|---|
| Comparative Example | A | 167 | 1.00 | 1000 | 120 |
| Comparative Example | B | 167→67 | 2.86→1.14 | 800 | 240→55 |
| Comparative Example | C | 167→67 | 1.25→0.50 | 800 | 140→10 |
| Comparative Example | D | 167→83 | 1.25→0.625 | 900→202 | 120 |
| This invention | E | 167→67 | 2.00→0.80 | 800 | 160→50 |
| This invention | F | 167→67 | 2.00→0.80 | 997→454 | 120 |
| This invention | G | 145→72 | 1.75→0.85 | 631 | 140→100 |
| This invention*2 | H-1 | 233→83 | 2.15→0.77 | 1350→468 | 120 |
| | H-2 | 83→33 | 1.92→0.77 | 1363→624 | 120 |
| This invention*2 | I-1 | 167→83 | 1.74→0.87 | 685 | 140→100 |
| | I-2 | 83→42 | 1.74→0.87 | 700 | 140→100 |

(Note)
*1$F_{02}$: oxygen supplying rate ($Nm^3$/h/ton),
$P_0/P_{0p}$: ratio (–) of properly expanding absolute secondary pressure of nozzle to absolute secondary pressure of nozzle,
LG: distance between the end of lance and the static bath surface of the molten steel (mm),
L: cavity depth in the molten steel (mm).
*2On the conditions H and I, use was made of a lance having gas pipes of two lines. Therefore, operation pattern of nozzles of these lines were also listed.

TABLE 3

| Section | Condition | Refining time | Amount of dust | Concentration at the end of refining (*)*1 [C] | [O] | (T.Fe) |
|---|---|---|---|---|---|---|
| Comparative Example | A*2 | 25.0 | 32.3 | 0.018 | 0.14 | 36.2 |
| Comparative Example | B*2 | 27.1 | 34.5 | 0.045 | 0.08 | 22.3 |

TABLE 3-continued

| Section | Condition | Refining time | Amount of dust | Concentration at the end of refining (*)*1 [C] | [O] | (T.Fe) |
|---|---|---|---|---|---|---|
| Comparative Example | C*2 | 22.0 | 29.0 | 0.09 | 0.08 | 21.7 |
| Comparative Example | D*2 | 25.5 | 30.5 | 0.015 | 0.07 | 20.2 |
| This invention | E | 27.2 | 25.1 | 0.014 | 0.09 | 24.4 |
| This invention | F | 25.3 | 25.3 | 0.012 | 0.07 | 18.5 |
| This invention | G*3 | 28.5 | 25.1 | 0.012 | 0.07 | 18.1 |
| This invention | H | 22.5 | 24.9 | 0.010 | 0.06 | 17.9 |
| This invention | I | 25.8 | 23.2 | 0.010 | 0.06 | 18.0 |

(Note)
*1Symbols in Table 3
[C]: carbon concentration in the steel bath (%),
[O]: free oxygen concentration in the steel bath (%),
(T.Fe): iron concentration in the slag (%).
*2On the condition A, the oxygen supplying rate was not lowered at the last period, and oxidation took place excessively causing (T.Fe) to increase.
On the condition B, the depth L was too great in the initial period to intermediate period, and dust and splash were generated in large amounts.
On the condition C, the distance L became too small in the last period, the oxygen gas did not reach the steel bath, and carbon was not decreased. During the refining, furthermore, slopping took place and the refining was interrupted.
On the condition D, the height of the lance was low in the last period, and the nozzle was melted and damaged conspicuously.
*3On the condition G, the blowing time was long, since the flow rate of oxygen gas was small in the initial period.

Example 2

The refining was carried out according to the method of tile present invention by using the same converter as that of Example 1 and by using a lance that is described below.

The top-blown lance possessed a basic shape as shown in FIGS. 7(A) and 7(B). The number of the nozzle openings, shape, gap and the thickness of the shielding plates were changed. The distance between the end of the lance and the bath surface was 0.5 to 1.5 m, the concentration of dust during the blowing was measured from the amount of dust in the dust-collecting water and was evaluated as an average rate of generation per unit blowing time. The lance was of the type in which the lance body was secured to the end of the lance that includes the center of the lance via the shielding plates.

In the test No. 1, use was made of a lance having nozzle openings 6 (B=100 mm, h=2 mm, B/h=50, (B·h)/R=1.2 mm, number of shielding plates=4, ω=25 degrees, thickness of the shielding plates=0.25×l mm, α=0.2 in the formula (5)) of a shape shown in FIGS. 7(A) and 7(B) and having, at the central portion thereof, a circular nozzle same as that of H-2 of Table 1. In a range (period I) where the carbon concentration was not smaller than 0.5%, oxygen was supplied through the slit-like nozzles at a rate of 150 to 250 $Nm^3$/h/ton and was supplied through the circular nozzle at a rate of 10 to 30 $Nm^3$/h/ton. In a range (period II) where the carbon concentration was from 0.5 to 0.2%, oxygen was supplied through the slit-like nozzles at a rate of 100 to 200 $Nm^3$/h/ton and was supplied through the circular nozzle at a rate of 30 to 50 $Nm^3$/h/ton. In a range (period III) where the carbon concentration was smaller than 0.2%, oxygen was supplied through the circular nozzle at a rate of 40 to 80 $Nm^3$/h/ton and nitrogen was supplied through the slit-like nozzles at a rate of 157 $Nm^3$/h/ton, and the blowing was discontinued at a carbon concentration of 0.02 to 0.04%.

As a result, dust was generated in an amount as small as 0.81 kg/(min·ton). In the period II and in the subsequent period, the average decarburization oxygen efficiency was as high as 85 to 90%, and (T.Fe) at blowing-out was as low as 8 to 12%. Similar results were obtained even when the number of the circular nozzles was threes (test No. 2: α=2 in the formula (1), V/W=0.4) and the number of the circular nozzles was six (test No. 3: α=0.2 in the formula (1), V/W=0.4). Nearly the same metallurgical properties were obtained even when concentric polygonal slit-like nozzles shown in FIG. 10 were used in the same blowing pattern (test Nos. 4 to 7: B, h, number of the shielding plates, ωthickness of the shielding plates, and α in the formula (5) were the same as those of the test No. 1).

During the decarburization reaction, the height of the lance was 700 to 900 mm in the period I, 700 to 900 mm in the period II, and 700 mm in the period III.

In the Comparative Examples of Table 3, on the other hand, dust was generated in amounts of 1.2 to 1.3 kg/min·ton, and (T.Fe) at blowing-out was as very high as 20% or more. On the conditions E to I of the present invention, dust was generated in an amount of 0.9 kg/min·ton, proving the effect of the circumferential slit-like nozzles.

TABLE 4

| | Test No. | Period I Rate of dust generation (Kg/(min · ton) | Period II and III Blowing-out (T.Fe) | Period II and III Generation of splash | Evaluation |
|---|---|---|---|---|---|
| This invention | 1 | 0.81 | 8–12 | Small | ○ |
| | 2 | 0.82 | 10–13 | Small | ○ |
| | 3 | 0.80 | 11–16 | Small | ○ |
| | 4 | 0.88 | 7–12 | Small | ○ |
| | 5 | 0.84 | 9–14 | Small | ○ |
| | 6 | 0.80 | 7–13 | Small | ○ |
| | 7 | 0.82 | 8–15 | Small | ○ |

Industrial Applicability

According to the present invention, it is possible to maintain the velocity of jets within a nearly predetermined range without being affected by an increase or decrease the flow rate of the oxygen gas and without so much decreasing the distance between the ends of the nozzles of the blowing lance and the static bath surface of the molten steel. It is therefore allowed to blow at high speed, to lower the generation of dust and spitting, to prevent the steel bath from being excessively oxidized and to decrease the formation of iron oxide in the slag without increasing the thermal load to the blowing lance. A complex mechanism is not required, either.

We claim:

1. A top-blown refining method in a converter maintaining an excellent decarburization performance by efficiently carrying out the blowing for decarburization to remove carbon from the molten steel from the initial period to last period of blowing by using a top-blown lance, said top-blown lance having nozzles blowing oxygen gas on a surface of a molten steel bath thereby forming a cavity having a depth with respect to a static surface of the molten steel bath prior to blowing, said method comprising the steps of:

finding a properly expanding absolute secondary pressure $P_{0p}$ of nozzles of said lance;

effecting the blowing by changing an oxygen supplying rate of oxygen gas supplied from the nozzles of said lance by changing an absolute secondary pressure $P_0$ of nozzles of said lance at least one time within an improperly expanding range which is from 0.7 to 2.5 times as great as said properly expanding absolute secondary pressure $P_{0p}$ of said nozzles; and adjusting the cavity depth in the surface of the molten steel formed by a jet of said oxygen gas produced by blowing.

2. A refining method according to claim 1, wherein, within the improperly expanding range which is from 0.7 to 2.5 times as great as the properly expanding absolute secondary pressure $P_{0p}$ of nozzles of said lance, a distance LG between the end of the lance and the static bath surface of the molten steel is found in compliance with the following formula (1) based on the absolute secondary pressure $P_0$ of nozzles of said lance and the cavity depth L in the molten steel that has been found in advance, and the blowing is carried out by moving said lance to maintain said distance LG, $$LG=H_c/(0.016\cdot L^{0.5})-L \quad (1)$$

where, allowable range of L is ±20%, $$H_c=f(P_0/P_{0p})\cdot M_{0p}\cdot(4.2+1.1M_{0p}^2)\cdot d_t$$

$$f(X)=\begin{cases}-2.709X^4+17.71X^3-40.99X^2+40.29X-12.90 & (\text{when } 0.7<X\leqq 2.1)\\ 0.109X^3-1.432X^2+6.632X-6.35 & (\text{when } 2.1<X<2.5)\end{cases}$$

LG: distance (mm) between the end of the lance and the static bath surface of the molten steel, L: predetermined cavity depth (mm) in the molten steel, $P_0$: absolute secondary pressure (kgf/cm$^2$) of nozzle, $P_{0p}$: properly expanding absolute secondary pressure (kgf/cm$^2$) of nozzle, $M_{0p}$: discharge Mach number (–) during the proper expansion, $d_t$: diameter (mm) of a throat portion of the nozzle.

3. A refining method according to claim 2, wherein, in the improperly expanding range which is from 0.85 to 1.75 times as great as the properly expanding absolute secondary pressure $P_{0p}$ of nozzle of said lance, the distance LG between the end of said lance and the static bath surface of the molten steel is found by using a value $P_0/P_{0p}$ near the upper limit of said-range in compliance with said formula (1), and the blowing is carried out by decreasing the oxygen supplying rate in a state where the distance LG is maintained nearly constant.

4. A refining method according to claim 1, wherein the cavity depth L in the molten steel is from 0.3 to 0.7 in terms of $L/L_0$ with respect to a depth $L_0$ of the bath of the molten steel.

5. A refining method according to claim 1, wherein the oxygen gas is supplied from the nozzles of said lance at a rate of 150 to 300 NM$^3$/h/ton in a range where the carbon concentration in the molten steel is not smaller than 0.5%, at a rate of 100 to 200 Nm$^3$/h/ton in a range where the carbon concentration in the molten steel is not smaller than 0.2% but is not larger than 0.5% and at a rate of 20 to 100 Nm$^3$/h/ton in a range where the carbon concentration in the molten steel is from 0.01 to 0.2%.

6. A refining method according to claim 1, wherein said top-blown lance has gas pipes of a plurality of independent lines and having a ratio of a minimum line to a maximum line in terms of the total areas of the nozzle throat portions of from 2 to 10.

7. A refining method according to claim 1, wherein said lance has gas pipes of two independent lines, and the blowing is carried out by supplying oxygen through the slit-like openings formed in the circumferential portions of the end of said lance and through circular openings formed at the central portions of the end of said lance, said slit-like openings and said circular openings being coupled to said pipes.

8. A refining method according to claim 1, wherein said lance has gas pipes of two independent lines, the oxygen supplying rate through the pipes of one line is changed over a range of from 10% to 90% of the total oxygen supplying rate through the two lines, the oxygen supplying rate through the other line is changed over a range of from 90 to 10% of the total oxygen supplying rate through the two lines so that the total rate is 100%, and the blowing is carried out in a manner that the oxygen supplying rate through the line having small areas of nozzle openings is gradually increased.

9. A refining method according to claim 8, wherein said lance has gas pipes of two independent lines, the openings formed in the peripheral portions of the end of the lance of one line have a long and narrow shape or a similar slit-like shape with a long side/short side ratio of not less than 5, the openings formed in the central portions of the end of the lance of the other line have a circular shape, and the oxygen supplying rate through the line having said circular openings is increased during the blowing.

10. A refining method according to claim 8, wherein in changing the oxygen supplying rate through the gas pipes of two independent lines of the lance, the average oxygen supplying rate per one opening of the central opening at the end of the lance is set to be not larger than 50% of the average oxygen supplying rate per one opening of the circumferential openings in a range where the carbon concentration is not smaller than 0.5% by weight during the decarburization processing, and the average oxygen supplying rate per one opening of the central opening is set to be not smaller than 70% of the average oxygen supplying rate per one opening of the circumferential openings in a range where the carbon concentration is not larger than 0.2% by weight.

11. A refining method according to claim 1, wherein in the decarburization reaction range where the carbon concentration is not smaller than 0.5% by weight, the absolute secondary pressure ratio $P_0/P_{0p}$ of a nozzle is selected to be from 1.75 to 2.5, $L/L_0$ is selected to be from 0.3 to 0.4, and oxygen is supplied through circular nozzles at a rate of 150 to 300 Nm$^3$/h/ton; in the decarburization reaction range where the carbon concentration is from 0.2 to 0.5% by weight, the absolute secondary pressure ratio $P_0/P_{0p}$ of a nozzle is selected to be from 1 to 1.75, $L/L_0$ is selected to be from 0.4 to 0.5, and oxygen is supplied through circular nozzles at a rate of 100 to 200 Nm$^3$/h/ton; and in the decarburization reaction range where the carbon concentration is from 0.01 to 0.2% by weight, the absolute secondary pressure ratio $P_0/P_{0p}$ of a nozzle is selected to be from 0.7 to 1, $L/L_0$ is selected to be from 0.5 to 0.7, and oxygen is supplied through circular nozzles at a rate of 20 to 100 Nm$^3$/h/ton.

12. A refining method according to claim 1, wherein use is made of a lance having gas pipes of two lines that can be controlled independently of each other, and wherein in the range where the carbon concentration is not smaller than 0.5% by weight, oxygen is supplied through slit-like or circular nozzles coupled to the circumferential gas-supplying pipe and is supplied through circular nozzles coupled to the central gas-supplying pipe, the oxygen supplying rate per one opening of the circular nozzle coupled to the central gas-supplying pipe is set to be not larger than 50% of the oxygen supplying rate per one opening of the slit-like or circular nozzle coupled to the circumferential oxygen-supplying pipe, and the oxygen gas is supplied through the two supplying pipes at a total rate of 150 to 300 $Nm^3/h/ton$ so that $L/L_0$ is from 0.5 to 0.3; in the decarburization reaction range where the carbon concentration is from 0.2 to 0.5% by weight, oxygen is supplied through slit-like or circular nozzles coupled to the circumferential gas-supplying pipe and is supplied through circular nozzles coupled to the central gas-supplying pipe, the oxygen supplying rate per one opening of the circular nozzle coupled to the central gas-supplying pipe is set to be not smaller than 70% of the oxygen supplying rate per one opening of the slit-like or circular nozzle coupled to the circumferential oxygen-supplying pipe, and the oxygen gas is supplied through the two supplying pipes at a total rate of 100 to 200 $Nm^3/h/ton$ such that $L/L_0$ is from 0.5 to 0.7; and in the decarburization reaction range where the carbon concentration is from 0.01 to 0.2% by weight, one kind or two or more kinds of nitrogen, carbon dioxide, argon and carbon monoxide are supplied through the slit-like or circular nozzles coupled to the circumferential gas-supplying pipe at a rate of 15 to 30 $Nm^3/h/ton$, and oxygen is supplied through the circular nozzles coupled to the central gas-supplying pipe at a rate of 20 to 100 $Nm^3/h/ton$, and so that $L/L_0$ is from 0.5 to 0.7 at any flow rate of the gas in a range where the carbon concentration is from 0.1 to 0.2%, the absolute secondary pressure ratio $P_0/P_{0p}$ of nozzle is set to be from 1.75 to 2.5, in a range where the carbon concentration is from 0.05 to 0.1%, the absolute secondary pressure ratio $P_0/P_{0p}$ of nozzle is set to be from 1.0 to 1.75, and in a range where the carbon concentration is from 0.01 to 0.05%, the absolute secondary pressure ratio $P_0/P_{0p}$ of nozzle is set to be from 0.7 to 1.0.

13. A refining method according to claim 1, wherein, in the improperly expanding range which is from 0.7 to 2.5 times as great as the properly expanding absolute secondary pressure $P_{0p}$ of a nozzle of said lance, a distance LG between the end of the lance and the static bath surface of the molten steel is found from the absolute secondary pressure $P_0$ of a nozzle of said lance and from the cavity depth L in the molten steel that has been found in advance in compliance with the following formula (6), and the blowing is carried out by moving said lance to maintain said distance LG, $$LG=H_d/(0.016\cdot L^{0.5})-L \tag{6}$$

where allowable range of L is ±20%, $$H_d = f(P_0/P_{0p})\cdot M_{0p}\cdot[(4.2+1.1M_{0p}^2)\cdot\beta]^{1/2}\cdot h$$

$$f(X)=\begin{cases}0.521X^4-2.422X^3+3.372X^2-0.644X+0.28 & (\text{when } 0.2<X\leqq 2.1)\\ -0.224X^3+2.14X^2-6.014X+6.71 & (\text{when } 2.1<X<4.2)\end{cases}$$

LG: distance (mm) between the end of the lance and the static bath surface of molten steel, $\beta=9.655\cdot(B/h)^{0.87}$ L: predetermined depth (mm) of dent in the molten steel, $P_0$: absolute secondary pressure ($kgf/cm^2$) of nozzle, $P_{0p}$: properly expanding absolute secondary pressure ($kgf/cm^2$) of nozzle, $M_{0p}$: discharge Mach number (–) during the proper expansion, h: length (mm) of the short side of the long and narrow shaped nozzle opening, B: length (mm) of the long side of the long and narrow shaped nozzle opening.

14. A refining method according to claim 13, wherein, in the improperly expanding range which is from 0.85 to 1.75 times as great as the properly expanding absolute secondary pressure $P_{0p}$ of nozzle of said lance, the distance LG between the end of said lance and the static bath surface of the molten steel is found by using a value $P_0/P_{0p}$ near the upper limit of said range in compliance with said formula (6), and the blowing is carried out by decreasing the oxygen supplying rate in a state where the distance LG is maintained nearly constant.

15. A top-blown lance for a top- and bottom-blown converter type refining furnace in which the steel bath is stirred by a gas maintaining excellent decarburization performance, said top-blown lance being constituted by a gas-supplying pipe having 2 to 10 shielding portions in portions of the slit-like nozzle openings having a concentric polygonal shape with three to sixteen corners or having a concentric circular shape in cross section, and a gas-supplying pipe having 1 to 6 circular nozzles on the inside of said slit-like nozzles independent of said gas-supplying pipe.

16. A top-blown lance for a converter according to claim 15, wherein the ratio B/h of the length h (mm) of the short side to the length B (mm) of the long side of the openings separated by said shielding portions is from 10 to 225, and, when the diameter of the lance is denoted by R (mm), the ratio (B·h)/R is 0.4 to 4 mm, and an angle ω subtended by a center of the lance and the points of the two neighboring openings closest to each other on a circumference is from 10 to 60 degrees.

17. A top-blown lance for a converter according to claim 15 or 16, wherein the thickness of the shielding portions is from 1 to 0.5 l (mm) with respect to the length l (mm) of nozzle of the gas-supplying pipe.

18. A top-blown lance for a converter according to claim 17, wherein the thickness of the shielding portions is from 1 to 0.3 l (mm) with respect to the length l (mm) of nozzle of the gas-supplying pipe.

19. A top-blown lance for a converter according to claim 15 to 18, wherein said shielding portions are shielding plates, and the lance body and the end of the lance including the center of the lance are secured together via said shielding plates.

20. A top-blown lance for a converter according to claim 15, wherein, in the circumferential direction of said slit-like nozzles, the width of the shielding plates is from 1.5 to 4 times as large as the width of other portions over a portion of from 0.01 l to 0.3 l mm (l is the length (mm) of the slit-like nozzles) from the end of the lance.

21. A top-blown lance for a converter that generates dust in small amounts according to claim 15, wherein, in the circumferential direction of said slit-like nozzles, the width of the shielding plates decreases at an angle of 10 to 80 degrees from the end of the lance toward the inside of the lance relative to the plane of the end of the lance within a portion of from 0.01 l to 0.3 l mm (l is the length (mm) of the slit-like nozzles) from the end of the lance.

* * * * *